US005709260A

United States Patent [19]

Wagstaff et al.

[11] Patent Number: 5,709,260

[45] Date of Patent: Jan. 20, 1998

[54] MOLTEN METAL ADMISSION CONTROL IN CASTING

[75] Inventors: Frank Everton Wagstaff, Media, Pa.; Aaron David Sinden, Latah; David Alan Salee, Spokane, both of Wash.

[73] Assignee: Wagstaff, Inc., Spokane, Wash.

[21] Appl. No.: 517,701

[22] Filed: Aug. 22, 1995

[51] Int. Cl.[6] ..... B22D 11/10; B22D 11/18

[52] U.S. Cl. ..... 164/453; 164/450.1; 164/483

[58] Field of Search ..... 164/453, 488, 164/450.1, 483

[56] References Cited

U.S. PATENT DOCUMENTS

| | | | |
|---|---|---|---|
| 2,962,778 | 12/1960 | Peak et al. | 164/450.1 |
| 3,677,333 | 7/1972 | Crowell | 164/483 X |
| 4,186,792 | 2/1980 | Yamada et al. | 164/450.1 |
| 4,470,446 | 9/1984 | Kamikawa et al. | 164/450.1 X |
| 4,567,935 | 2/1986 | Takeda et al. | 164/450.1 |
| 4,730,660 | 3/1988 | Tinnes et al. | 164/453 |
| 5,174,361 | 12/1992 | Kursfeld | 164/453 |
| 5,409,054 | 4/1995 | Moriceau | 164/483 X |
| 5,526,870 | 6/1996 | Odegard et al. | 164/453 X |

FOREIGN PATENT DOCUMENTS

| | | | |
|---|---|---|---|
| 0137239 | 4/1985 | European Pat. Off. | 164/450.1 |
| 2109723 | 6/1983 | United Kingdom | 164/450.1 |

*Primary Examiner*—J. Reed Batten, Jr.
*Attorney, Agent, or Firm*—Christopher Duffy

[57] ABSTRACT

To control the admission of molten metal to a series of mold cavities through a series of valve openings in the downspouts of a trough thereabove, an elongated rack is arranged parallel to the trough, a set of balance beams is pivotally mounted on the rack, a set of valve closure devices is suspended from corresponding first end portions of the beams for throttling the openings, and a set of float sensors is suspended from points on the opposing second end portions of the beams for contact with the surfaces of the molten metal in the cavities. After an initial phase of the fill operation in which the surfaces of the molten metal reach a state of equilibrium at an intermediate elevation above the tops of the blocks, the rack is elevated in relation to the series of cavities so that as the first end portions of the beams impose a desired value on the rate at which the surfaces escalate up the vertical axes of the cavities, the second end portions raise the elevation of the suspension points for the sensors at a rate commensurate therewith so that the input signals transmitted to the first portions from the second portions through the fulcra for the beams, are consistent with the imposed value. In other versions using non-contact sensors hung from the rack, the input signals are developed electrically and transmitted through an electronic controller which either transmits them electrically to motor driven linear actuators for a set of balance beams on the trough from which the valve closure devices for the openings are suspended, or through a device which converts the electrical signals to pneumatic signals for pneumatically driven actuators for the set of trough mounted beams. In either of the latter versions, the desired value may be imposed on the actuators from the controller, and the rack elevated to raise the signal generation points of the sensors at a rate commensurate therewith, or the opposite may be done, in either case to assure that the imposed value and the input signals transmitted to the actuators for the balance beams are consistent with one another.

30 Claims, 17 Drawing Sheets

MOLTEN METAL ADMISSION CONTROL IN CASTING

TECHNICAL FIELD

Our invention relates to the casting of molten metal into elongated bodies of metal, and in particular, to controlling the admission of the molten metal to the casting apparatus when the bodies are cast in an open top casting apparatus.

BACKGROUND ART

In casting with an open top casting apparatus, molten metal is introduced into one end of an elongated trough which is arranged above the casting apparatus and has a series of valve openings therein which are spaced apart from one another in a line extending along a parallel to the bottom of the trough, and are in registry with the relatively upper end openings of a series of open ended mold cavities in the casting apparatus which are spaced apart on vertical axes and disposed so that the relatively lower end openings of the respective cavities coincide with a plane parallel to the line of valve openings. The cavities also have a series of bottom blocks telescopically engaged therein at the relatively lower end openings thereof to form sumps within the cavities for the temporary retention of the molten metal therein, and when the molten metal is admitted to the respective cavities at the valve openings corresponding thereto, it forms columns of molten metal upright on the tops of the blocks, and the columns escalate up the axes of the cavities at the surfaces thereof to partially fill the sumps. Then, when the surfaces of the respective molten metal columns have risen to an elevation above the tops of the blocks at which the columns sufficiently fill the sumps to warrant start-up of the casting operation, the casting apparatus and the blocks are reciprocated relatively away from one another along the axes of the cavities to release the columns for travel along the axes, and in the meantime, more molten metal is admitted to the cavities at the series of valve openings to maintain the surfaces of the respective molten metal columns at an operating elevation in which, as the respective molten metal columns cool, they increase their length to form elongated bodies of metal supported upright on the blocks.

Controlling the admission of the molten metal to the cavities during the casting operation has been possible for many years. But being able to also control the admission of the molten metal to the cavities during the fill operation leading up to it, has been a more difficult objective to achieve. This has been true, moreover, even though there has been considerable motivation for being able to do so. The short length molten metal columns which first occupy the sumps during the fill operation, form the so-called "butts" of the bodies of metal or "castings" supported on the blocks. And the formation of a good butt has always been critical to the success of every casting procedure. if the molten metal fills a sump too slowly and solidification of the metal proceeds too rapidly, a "cold joint" or separated butt can occur. This leads to excessive butt scrap, and can be the initiator of other problems as well during the start-up of the casting operation itself. Moreover, if the cooling effect on the lateral faces of a butt is too severe, compared to the cooling effect occurring at the bottom of the butt, the butt can "curl" along its longitudinal axis, and this can also initiate other problems. For one, the weight of the metal at the now unsupported end of the casting, can cause the butt to break down and to initiate cracks which usually propagate up the length of the casting. Or a curled butt can become lodged in the lower end opening of its cavity and to the extent that it is temporarily suspended and unsupported by the block for it. Thereafter, when the butt contracts and drops, the molten metal at the lower end opening of the cavity is dumped into the pit, with the immediate potential for an explosion therein. Or a curled butt can create gaps at the lower end opening of the cavity to the extent that molten metal dumps directly into the pit, again raising the potential for an explosion. And finally, if the conditions under which the butt of a casting is formed, are not properly controlled, unexpectedly high temperatures can occur at the lateral faces of the casting, and can cause hot cracks which may or may not heal at the butt, but more commonly propagate up the length of the casting.

For these and other reasons, the metal casting industry has long sought a process and apparatus with which to exercise control over the admission of the molten metal to the cavities during the entire casting procedure, including the fill operation. In particular, the industry has sought a process and apparatus of this nature which could be used to exercise control on a repeated basis, that is, with uniformly reliable results from one casting procedure to another when multiple procedures are carried out in succession.

Prior to 1985 and for many decades, controlling the admission of the molten metal to the cavities had been accomplished with sets of valve and sensor devices that were operable, respectively, to control the admission of molten metal to the respective cavities at the respective valve openings corresponding thereto, and to sense the elevation of the surfaces of the respective molten metal columns formed in the respective cavities during the casting operation, and to transmit to a control apparatus at signal generation points spaced above the respective surfaces, signals representing the elevations of the respective surfaces. The respective valve devices were suspended from a set of first carrier means that were formed by the corresponding right or left-hand outboard end portions or arms of a set of balance beams that were pivotally mounted on an elongated support fixedly secured to one side of the trough, and that were oriented so as to cantilever the arms over the respective valve openings in the trough and to suspend the respective valve devices in cooperative association with the respective valve openings corresponding thereto. Meanwhile, the opposing outboard end portions or arms of the balance beams were cantilevered over the relatively upper end openings of the cavities, and the respective sensor devices were suspended from them in such disposition above the tops of the blocks as to transmit the respective signals thereof when the molten metal had escalated up the axes of the cavities to the extent of activating the sensor devices. However, the point of activation was not until the fill had been completed. Because of the fixed relationship between the support for the balance beams and the plane with which the relatively lower end openings of the cavities coincided, the beams and the respective valve and sensor devices suspended therefrom, could not exercise control during the fill operation itself. Moreover, the beams and the respective valve and sensor devices could exercise control over the casting operation only if the operating elevation was substantially the same as the start-up elevation. They could not be used to raise and lower the elevation of the surfaces. In short, the control effected was limited to maintaining the operating elevation, and the initial stage of the casting procedure, the fill operation, had to be conducted as a "free fill," that is, as one in which the control effected was exercised by an operator who was trained to prepare for, observe and manipulate the fill operation sufficiently to achieve a crack-free butt and a safe start.

Then, in 1985 and 1986, Takeda et al issued two patents, U.S. Pat. No. 4,498,521 and U.S. Pat. No. 4,567,935, in which their apparatus and technique exercised control over the admission of the molten metal throughout the entire casting procedure, including the fill operation. To do so, they secured the cases of a set of displacement transducers to one side of the trough, suspended a set of float-type sensor devices from the internal displacement components of the set of transducers, and brought in an equal number of so-called electronic "local controllers" that received a set point signal from still another electronic controller, a so-called "master controller," compared the signals transmitted by the respective displacement components of the transducers with the set point signal, and generated from the two the differentials necessary to control the balance of the fill operation after the valve devices had been prepositioned to establish somewhat of a state of equilibrium in the surfaces of the respective molten metal columns during the initial phase of the fill operation.

A subsequent Australian patent Application, No. 17256/92, also disclosed a similar apparatus, and while the Australian and Takeda et al apparatus were effective for the purpose intended, those who employed the respective apparatus found them highly expensive, both to purchase and to maintain, because of the numerous electronic components in them and the fact that in use all of the electronic components were subjected to the intense heat of the casting procedure. Heat is highly deleterious to electronic components and they require close monitoring and maintenance to assure that they will operate reliably from one procedure to the next. It was a principal objective of our invention, therefore, to provide an apparatus and technique wherein control could be exercised over the entire casting procedure without the use of an undue number of electronic components, and particularly ones which would be exposed to the heat of the casting procedure, and particularly the heat of the trough and that portion of the casting apparatus defining the mold cavities therebelow. We also sought to provide an apparatus and technique of this nature wherein we could fulfill certain other objectives, such as a wider range of control over the casting operation itself, but these will best be explained as our invention is explained more fully hereafter.

DISCLOSURE OF THE INVENTION

In accordance with our invention, we support the sets of valve and sensor devices on first and second carrier means which are each arranged in a line extending parallel to the line of valve openings in the trough, and each supported so that the respective carrier means therein are reciprocable relatively transverse the line thereof. We suspend the set of valve devices from the set of first carrier means so that they are disposed above the respective valve openings corresponding thereto, and to be reciprocated in conjunction with the respective first carrier means between variable positions in which the molten metal is admitted to the respective cavities at variable flow rates commensurate therewith. And we suspend the set of sensor devices from the set of second carrier means so that they are spaced above the tops of the blocks forming the respective sumps corresponding thereto, and operable to generate the respective signals thereof at points spaced above the surfaces of the respective molten metal columns formed in the sumps during the fill operation. Before the commencement of the fill operation, we preposition the set of valve devices at positions in which the respective valve devices admit the molten metal to the respective sumps corresponding thereto in amounts that are varied commensurate with the distance lying along the line of valve openings between each of the valve openings and the one end of the trough, so that as the surfaces of the respective molten metal columns escalate up the axes of the cavities toward the sensor devices corresponding thereto during the initial phase of the fill operation, the surfaces establish a state of substantial equilibrium with one another at an intermediate elevation between the tops of the blocks and the start-up elevation for the casting operation. Then, after the surfaces establish a state of substantial equilibrium with one another at the intermediate elevation, we interconnect with each of the respective sensor devices and the respective first and second carrier means corresponding thereto, a control device which is operable to transmit to the respective valve devices corresponding thereto, input signals which are both a function of the vertical distance between the line of second carrier means and the plane with which the relatively lower end openings of the cavities coincide, and a function of the vertical distance between the signal generation points of the respective sensor devices and the surfaces of the respective molten metal columns corresponding thereto. We also reciprocate one of the sets of first and second carrier means relatively transverse the line thereof to impose a desired value on the rate at which the surfaces escalate up the axes of the cavities in the direction of the start-up elevation from the intermediate elevation. And we reciprocate the other of the sets of first and second carrier means relatively transverse the line thereof so that as the surfaces escalate up the axes of the cavities at the desired value, the other set of carrier means raises the elevation of the signal generation points of the respective sensor devices at a rate sufficiently commensurate therewith to render the input signals transmitted to the respective first carrier means by the control device substantially consistent with the desired value. In this way, we not only complete the fill, but we also have at our command, a number of options for the casting operation itself.

For one, when the surfaces of the respective molten metal columns reach the start-up elevation and the casting apparatus and the blocks are reciprocated relatively away from one another along the axes of the cavities to start the casting operation, we may reciprocate the one set of carrier means in an additional step to maintain the surfaces of the respective molten metal columns at the start-up elevation as an operating elevation for the casting operation. We may also reciprocate the other set of carrier means during the additional step to maintain the elevation of the signal generation points of the respective sensor devices within a predetermined range of vertical distance from the surfaces of the respective molten metal columns corresponding thereto.

Or, when the surfaces reach the start-up elevation and the casting apparatus and-the blocks are reciprocated to start the casting operation, we may reciprocate the one set of carrier means in an additional step, first, to raise the surfaces of the respective molten metal columns to an elevation spaced above the operating elevation, and then to lower the respective surfaces to the operating elevation for the casting operation. That is, we may overfill the cavities during the initial phase of the casting operation, before lowering the respective surfaces to the operating elevation for the remainder of the casting operation. Once again, moreover, we may reciprocate the other set of carrier means during this additional step to maintain the elevation of the signal generation points within a predetermined range of vertical distance from the surfaces of the respective molten metal columns corresponding thereto.

Thirdly, when the surfaces reach the start-up elevation and the casting apparatus and the blocks are reciprocated to start the casting operation, we may reciprocate the one set of carrier means in an additional step, first, to raise the surfaces of the respective molten metal columns to a still higher elevation spaced above the start-up elevation, and then to maintain the surfaces of the respective molten metal columns at the still higher elevation as an operating elevation for the casting operation. And once again, we may reciprocate the other set of carrier means during this additional step to maintain the elevation of the signal generation points of the respective sensor devices within a predetermined range of vertical distance from the surfaces as indicated previously.

Fourthly, when the surfaces have reached the start-up elevation, an operating elevation has been established of at least the start-up elevation, the casting apparatus and the blocks have been reciprocated relatively away from one another at a particular speed during a first portion of the casting operation, and then are reciprocated relatively away from one another at a second and different speed during a second portion of the casting operation, we may reciprocate the one set of carrier means in an additional step to relocate the surfaces of the respective molten metal columns to a new operating elevation commensurate with the second speed. And, once more, we may reciprocate the other set during the additional step to maintain the elevation of the signal generation points of the respective sensor devices as indicated.

In many of the presently preferred embodiments of our invention, we use as the sensor devices, non-contact sensors, we suspend the sensors from the second set of carrier means so that they have signal generation points at a predetermined distance above the surfaces of the respective molten metal columns corresponding thereto when the surfaces establish a state of substantial equilibrium with one another at the intermediate elevation, and we reciprocate the other set of carrier means to raise the elevation of the signal generation points of the respective sensors at a rate whereby the respective signal generation points maintain a predetermined range of vertical distance above the respective surfaces corresponding thereto that includes the aforesaid predetermined vertical distance. For example, in some embodiments, we reciprocate the set of first carrier means to impose the desired value on the rate at which the surfaces of the respective molten metal columns continue to escalate up the axes of the cavities after the initial phase of the fill operation, and we reciprocate the set of second carrier means to raise the signal generation points of the respective sensors at a rate whereby the respective signal generation points maintain the predetermined range of vertical distance above the respective surfaces corresponding thereto. In other embodiments, we do just the opposite; we reciprocate the set of second carrier means to impose the desired value on the rate at which the surfaces continue to escalate up the axes of the cavities after the initial phase of the fill operation, and we reciprocate the set of first carrier means to raise the signal generation points at a rate whereby the respective points maintain the predetermined range of vertical distance above the respective surfaces corresponding thereto.

In still other presently preferred embodiments of our invention, we use as the sensor devices, contact sensors, and we suspend the sensors from the set of second carrier means so that they contact the surfaces of the respective molten metal columns corresponding thereto and have signal generation points spaced thereabove at substantially a fixed distance from the respective surfaces corresponding thereto when the surfaces establish a state of substantial equilibrium with one another at the intermediate elevation. Meanwhile, we reciprocate the other set of carrier means to raise the signal generation points of the respective sensors at a rate whereby the respective signal generation points maintain substantially the fixed vertical distance above the surfaces without lift from the columns themselves at the surfaces thereof. In certain embodiments, we reciprocate the set of first carrier means to impose the desired value on the rate at which the surfaces continue to escalate up the axes of the cavities after the initial phase of the fill operation, and we reciprocate the set of second carrier means to raise the signal generation points at a rate whereby the points maintain substantially the fixed vertical distance above the surfaces without lift from the columns themselves at the surfaces thereof. In one particular group of embodiments, to be illustrated hereinafter, we even mount the set of first carrier means on the set of second carrier means, and then reciprocate the set of second carrier means to impose the desired value and raise the signal generation points at the same time.

In fact, in certain embodiments of the group, wherein the sensor devices take the form of sensors which transmit first signals at the respective signal generation points thereof when contacted by the surfaces of the respective molten metal columns in the sumps, we use a control device in the form of rotary actuators which are pivotally mounted at fulcra on the respective second carrier means, yieldably biased to rotate in the direction in the tops of the blocks corresponding thereto, and have the respective sensors suspended therefrom at the respective signal generation points thereof to integrate with the respective first signals when the respective sensors are contacted by the surfaces of the respective molten metal columns corresponding thereto after the initial phase of the fill operation, second signals representing the vertical distance between the line of second carrier means and the plane with which the relatively lower end openings of the cavities coincide, and to deliver the respective integrated first and second signals as input signals to drive means which are interposed between the respective actuators and the respective first carrier means corresponding thereto, to vary the positions of the respective valve devices suspended therefrom relative to the respective valve devices corresponding thereto. Moreover, on occasion, the set of valve devices is prepositioned before the commencement of the fill operation, by releasably detaining the respective rotary actuators against the bias thereon at angular positions disposed about the fulcra on the respective second carrier means corresponding thereto in which the respective valve devices admit the molten metal to the respective sumps corresponding thereto in the amounts described until the respective sensors are contacted by the surfaces of the respective molten metal columns corresponding thereto at the intermediate elevation. On occasion, too, as shall be illustrated, we rigidly interconnect the respective first carrier means with the respective rotary actuators corresponding thereto to form balance beams having the respective valve and sensor devices suspended from points thereon which are spaced apart from the respective fulcra thereof on the respective second carrier means corresponding thereto, and we engage trigger devices with the respective balance beams to releasably detain the respective rotary actuators thereof against the bias thereon until the surfaces of the respective molten metal columns engage the sensors to disengage the trigger devices from the respective rotary actuators.

In one especially advantageous group of embodiments, we use as the sensor devices, sensors which transmit first electrical signals at the signal generation points thereof when spaced apart from the surfaces of the respective molten metal columns formed in the respective sumps corresponding thereto, and we employ as the control device, an electronic controller which is connected to the respective sensors and the respective second carrier means corresponding thereto, to integrate with the respective first electrical signals when the surfaces of the respective molten metal columns assume a state of substantial equilibrium with one another at the intermediate elevation, second electrical signals representing the vertical distance between the line of second carrier means and the plane with which the relatively lower end openings of the cavities coincide, and to deliver the integrated first and second electrical signals as input signals to drive means which are interposed between the controller and the respective first carrier means corresponding to the respective sensors, to vary the positions of the respective valve devices suspended from the respective first carrier means relative to the respective valve openings corresponding thereto.

The respective drive means may take the form of electric motor driven actuator devices. But preferably, they take the form of pneumatically driven actuator devices, and we interpose a signal conversion device between the electronic controller and the respective actuator devices to convert electrical input signals transmitted by the electronic controller into pneumatic input signals for the respective pneumatically driven actuator devices. Also, we commonly interpose fluid dampener devices between the respective actuator devices and the signal conversion device to resist the introduction of relatively low pressure feedback signals to the respective pneumatic input signals for the actuator devices when suction occurs in the respective valve openings corresponding to the respective actuator devices.

In one especially advantageous arrangement, we use as the actuators, bellows motors having driven ends thereon, and we interpose liquid reservoirs between the signal conversion device and the respective bellows motors, we form restricted liquid flow passages within the respective reservoirs that communicate at corresponding ends thereof with the pneumatic input signals from the signal conversion device and at opposing ends thereof with the driven ends of the respective bellows motors, and we charge the respective passages with dampener liquid that is contained by the respective reservoirs corresponding thereto, to transmit the respective pneumatic pressure signals to the driven ends of the respective bellows motors corresponding thereto, but substantially resist the transmission of relatively low pressure feedback signals to the respective pneumatic input signals from the driven ends of the respective bellows motors because of the restriction in the respective liquid flow passages.

At present, we have found it to be particularly advantageous to mount the second set of carrier means on elevator means so that they can be reciprocated therewith along parallels to the axes of the cavities. Moreover, we often interconnect the respective second carrier means with one another along the line thereof to form a rack for the respective sensor devices. Sometimes, we even elongate the rack along the line thereof so that the rack is coextensive with the line of valve openings, and we suspend the respective sensor devices below the rack at points thereon opposed to the respective valve openings corresponding thereto, for example, when the control device takes the form of an electronic controller. At other times, we elongate the rack along the line thereof so that the rack is coextensive with the line of valve openings, and we support the respective sensor devices on top of the rack at points thereon opposed to the respective valve openings corresponding thereto. This might be the case, for example, when we use rotary actuators as the control device, pivotally mount the actuators at fulcra on the rack, rigidly interconnect the first carrier means corresponding thereto with the respective actuators to form balance beams, and pivotally suspend the respective valve and sensor devices corresponding to the respective first carrier means from the relatively outboard end portions of the respective balance beams at points spaced apart from the respective fulcra thereof.

BRIEF DESCRIPTION OF THE DRAWINGS

These features will be better understood by reference to the accompanying drawings wherein we have illustrated one of the last mentioned group of rack mounted balance beam embodiments using contact sensors, and one of the group of rack mounted embodiments mentioned therebefore wherein the sensor devices are non-contact sensors and the control device is an electronic controller. We have also illustrated both an electro-pneumatic version of the electronic controller group, and a less desirable electromechanical alternative thereto, as well as certain appurtenances and options to the basic assembly in the balance beam embodiment.

In the drawings.

BEST MODE FOR CARRYING OUT THE INVENTION

Figure 1:
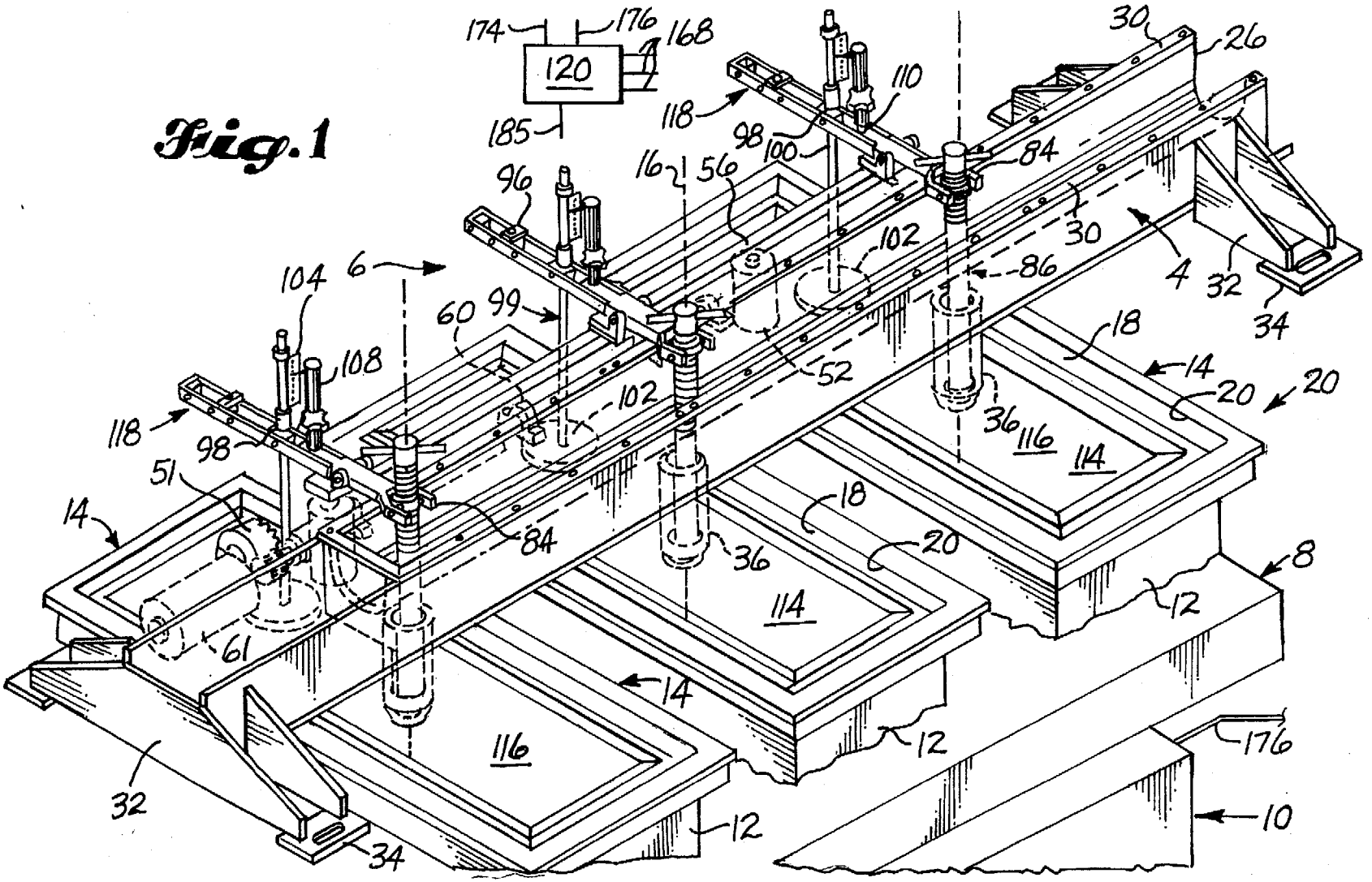
FIG. 1 is a perspective view of the basic assembly in the balance beam embodiment.
Figure 2:
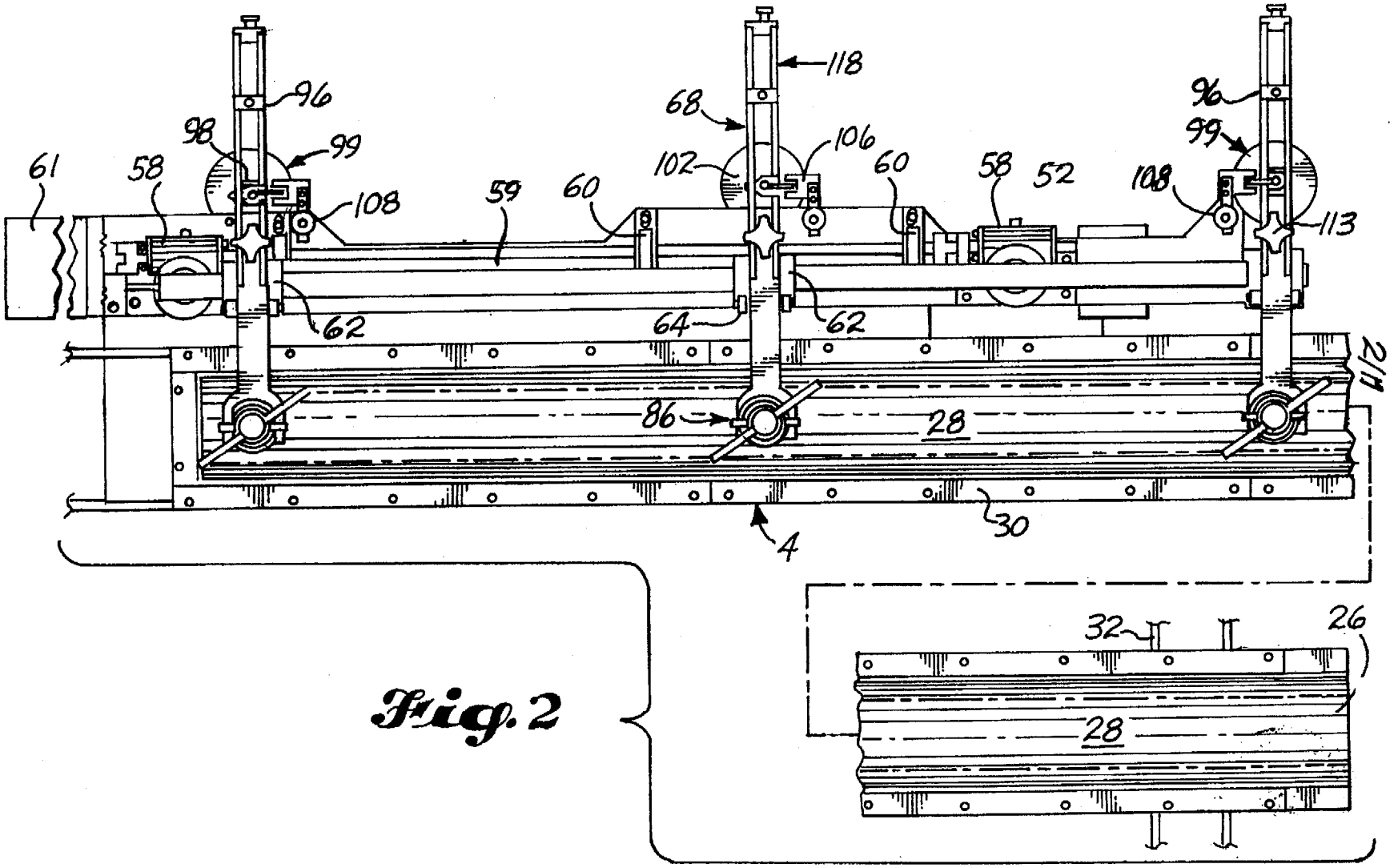
FIG. 2 is a plan view of the same from above.
Figure 20:
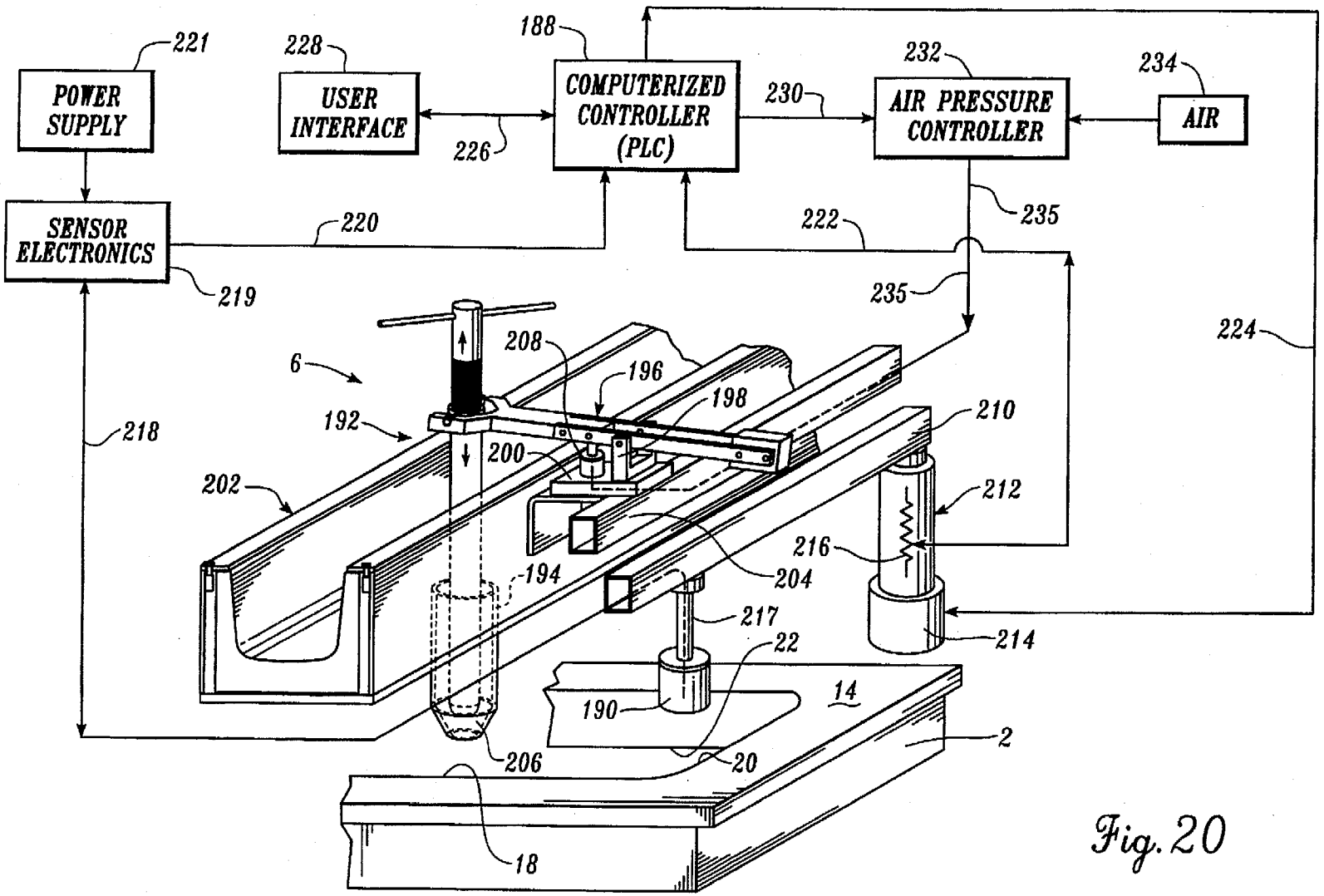
FIG. 20 is a part perspective, part schematic view of the basic assembly in the electro pneumatic version of our invention employing an electronic controller as the control device, and non-contact sensors on the rack thereof.

The casting apparatus 2 seen in FIGS. 1 and 20 is commonly retractably mounted at one side of a pit (not shown), as are the trough 4 and the basic rack mounted control apparatus 6; and to start each casting procedure, first the casting apparatus 2 and then a composite of the trough 4 and the control apparatus 6, is swung into a horizontal over the pit. Then, at the conclusion of the procedure, each is swung back in reverse order for access to and removal of the casting from the pit. In the pit, meanwhile, a platen 8 is mounted on a hydraulic ram or other elevator means 10 to be raised and lowered vertically of the pit, and the platen in turn has a series of bottom blocks 12 relatively upstanding thereon for engagement with the casting apparatus 2 when the assembly is disposed in a horizontal over the pit.

The casting apparatus itself is conventional in nature, and for ease of illustration, it is represented by a series of the open ended molds 14 with flanged rims thereabout commonly used in the apparatus. The molds 14 are spaced apart on vertical axes 16, and at their axes, they have shallow, rectangularly shaped, open ended cavities 18 therein which in turn have coplanar relatively upper end openings 20 at the top thereof and coplanar relatively lower end openings 22 (FIGS. 7–10) at the bottom thereof. The molds also have annular slots 24, or galleries of spaced holes, circumposed about the relatively lower end portions of the cavities, for the discharge of liquid coolant onto the elongated molten metal bodies or castings formed in the molds during each casting procedure. The castings are commonly referred to as ingots.

The trough 4 is open at one end 26 and closed at the other; and has a double-walled sidewall construction and a refractory liner 28 seated therein between the sidewalls thereof. The sidewalls are tapered and gunnel plates 30 are secured along the respective sidewalls of the trough and the liner at the tops thereof. Meanwhile, at its outsides, the opposing ends of the trough are equipped with brackets 32 having feet 34 thereon, and the feet are secured to the top of the casting apparatus to extend the trough in gantry-like fashion above the relatively upper end openings 20 of the series of cavities 18, and cross-wise the longer dimensions of them at the axes 16 thereof. This leaves areas of considerable size open to either side of the trough, at the relatively upper end openings of the cavities. At the axes, moreover, the trough has openings in the bottom thereof, through both the liner and the bottom of the trough itself, and refractory downspouts 36 are seated in the respective openings to depend below the trough into the respective cavities corresponding thereto in the casting apparatus. In addition, the downspouts also depend within a series of sleeves 38 that depend from the underside of the trough and the respective sleeves are equipped with set screws for securing the downspouts to the trough. Meanwhile, a hanger 40 is suspended from the sides of the trough at each downspout and a frame 42 is removably suspended in turn from the hanger, with a perforated sock 44 suspended in turn on it, at an elevation below the bottom of the respective downspout, to filter and aid in distributing the molten metal to the respective cavity in conventional fashion.

At the inside thereof, each downspout is cylindrical, but at the bottom thereof, each has a hemispherical nozzle 46 therein which in turn has an opening 48 at the bottom thereof for the discharge of molten metal to the cavity corresponding thereto. In each casting procedure, the respective openings 48 in the nozzles of the downspouts form valve openings that are spaced apart from one another in a line extending along a parallel to the bottom of the trough, and are in registry with the relatively upper end openings 20 of the respective cavities in the casting apparatus. Further reference will be made to this line, as well as to the plane occupied by the relatively lower end openings 22 of the cavities in the casting apparatus.

Referring now to FIGS. 1–19 in particular, it will be seen that at its right-hand side in FIGS. 7–10, and at the left-hand side thereof in FIG. 1, the trough has a shelf 50 secured thereon between the brackets 32 at the opposing ends thereof. A hood 51 is also mounted over the shelf, but the hood is largely omitted to reveal that portion of the assembly therebelow in the various views. In particular, at spaced locations on the shelf, a pair of machine jacks 52 is mounted upright thereon to form elevator means for the caps 54 thereof. An elongated hollow rack 56 is mounted in turn on the caps 54 of the jacks, and in a parallel to the line of valve openings 48. Below the rack, worm gears 58 are engaged with the linear actuators (not shown) of the respective jacks, and a shaft 59 is extended along a parallel to the rack, in pillow blocks 60, to interconnect with and drive the respective actuators through the respective worm gears corresponding thereto. A reversible electrical motor 61 is mounted in turn on the nearer end wall of the hood 51 in FIG. 1, and is flexibly coupled to the shaft to complete the drive train for the jacks, there also being a flexible coupling at the opposing end of the shaft where it interconnects with the worm gear 58 for the more remote jack. The rotation of the motor dictates the movement of the respective jacks, and depending on the direction of rotation, the caps 54 of the jacks may be raised or lowered relative to the plane with which the relatively lower end openings 22 of the cavities in the casting apparatus coincide. The respective jacks can also be expected to travel up and down a prescribed distance for each turn of the motor 61, so that by controlling the rotation of the motor and the shaft 59 connected to it, the travel of the jacks and the direction thereof can be controlled in turn.

Figure 14:
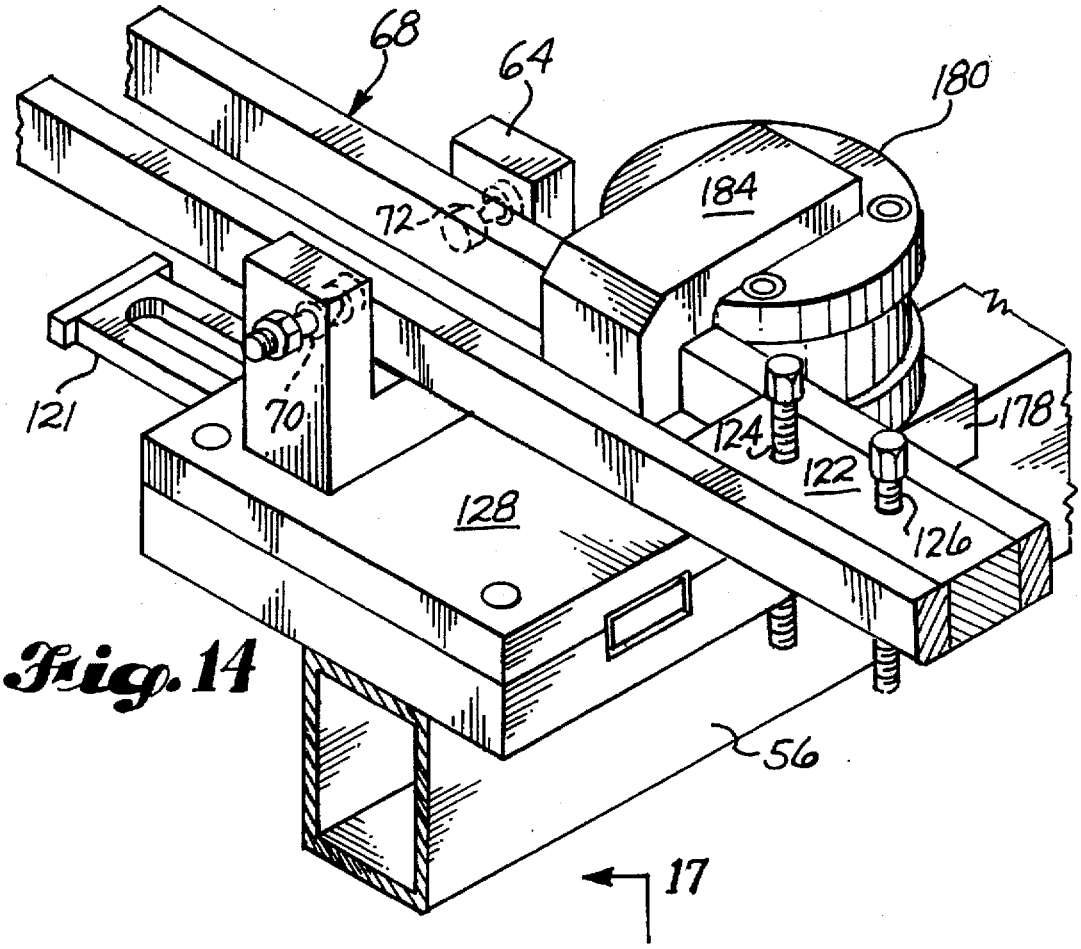
FIG. 14 is a part perspective view of the assembly wherein each casting station has been modified to include a device which is operable to signal a master controller for the assembly, firstly, that the respective trigger device thereof is engaged with the balance beam corresponding thereto, to preposition the respective valve device thereof and elevate the respective sensor device thereof above the top of the block corresponding thereto, and secondly, that the respective trigger device has been disengaged from the balance beam corresponding thereto in the condition of FIG. 8; and showing additionally, more details of the features added through FIGS. 11–13.
Figure 15:
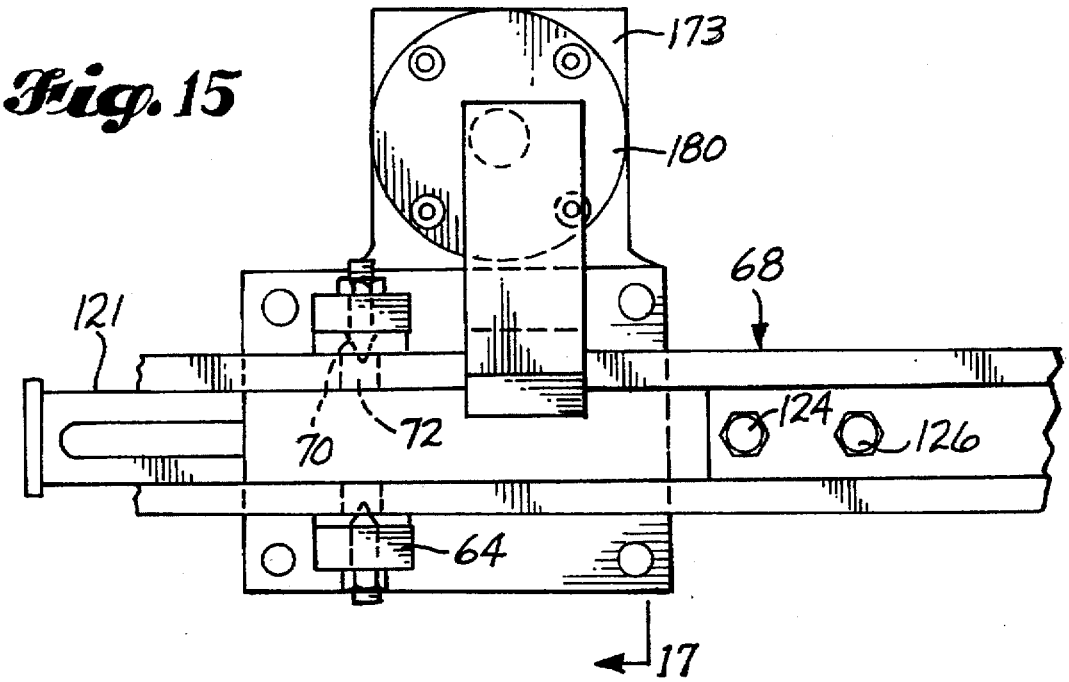
FIG. 15 is a plan view of the features added through FIGS. 11–14, from the top thereof.
Figure 16:
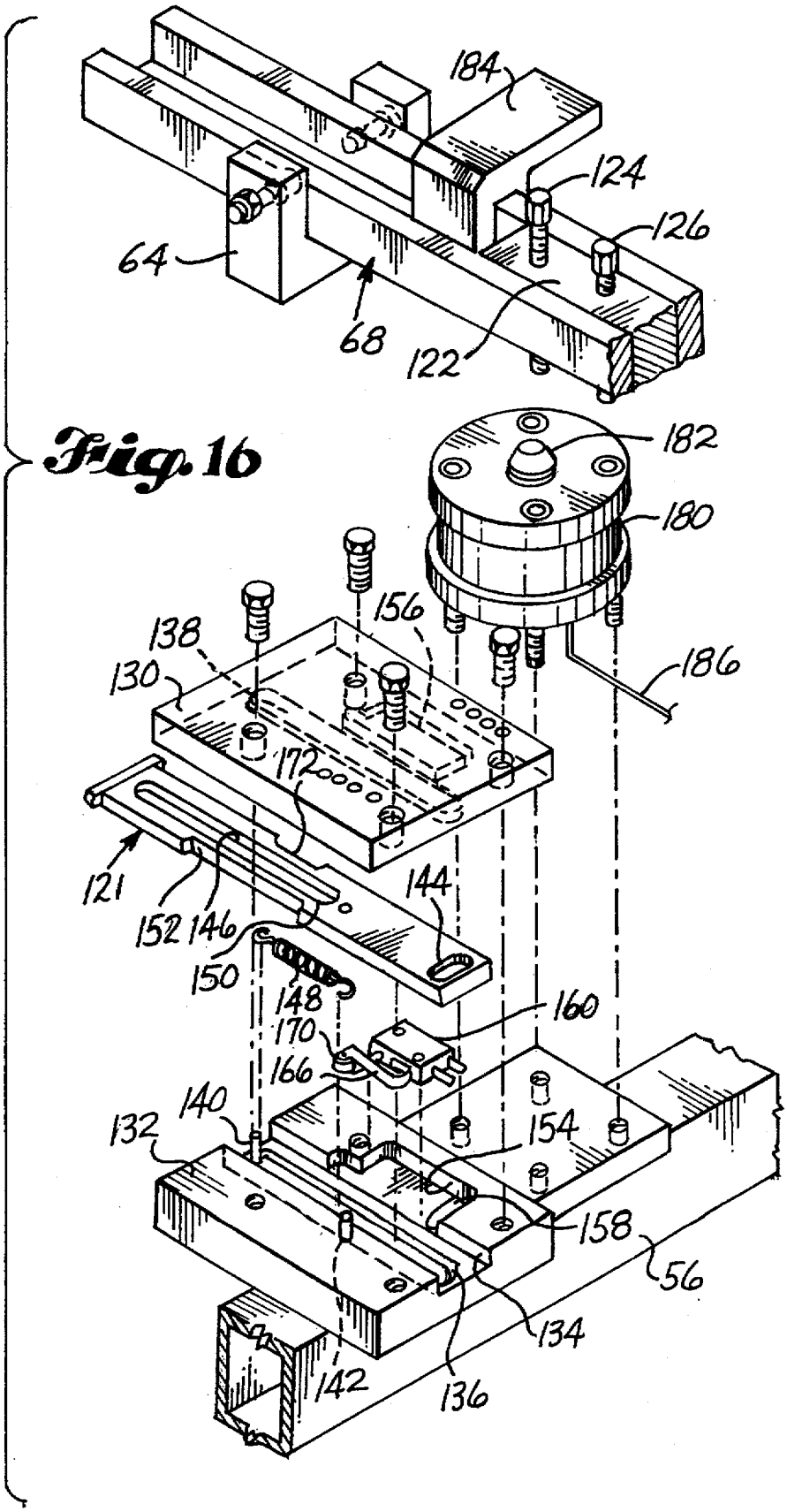
FIG. 16 is an enlarged and partially exploded perspective view of the various added features.
Figure 18:
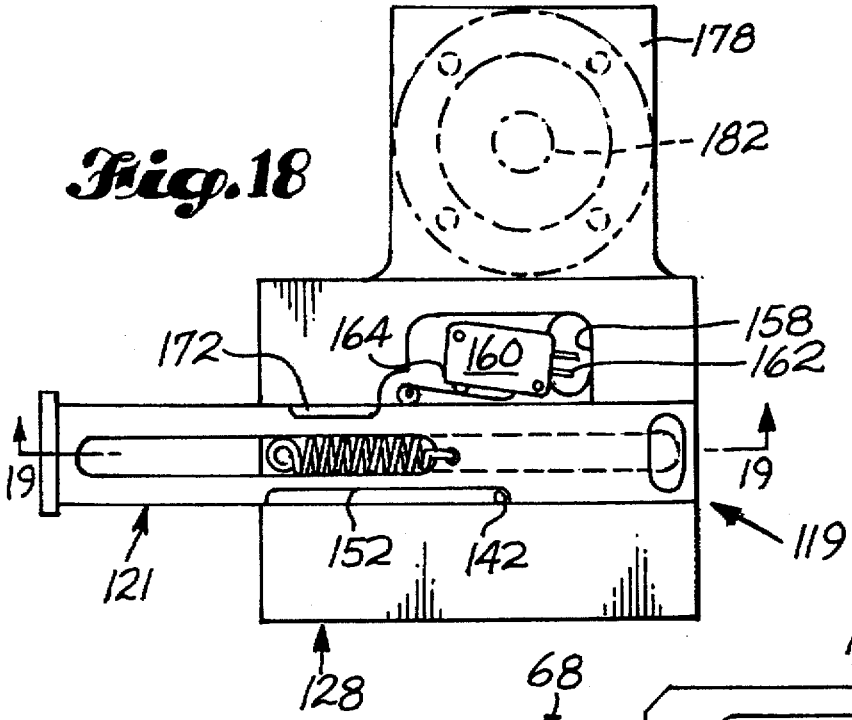
FIG. 18 is a cross sectional view along the line 18—18 of FIG. 17.

Laterally opposed to the trough and on top of the rack, at each casting station, is a flat rectangular housing 62 and a U-shaped saddle 64 mounted in turn at the top thereof. The respective housings 62 provide cases for a series of trigger devices 66 employed in each casting procedure, and the respective saddles 64 provide gimbals for a series of balance beams 68 which are pivotally mounted in the respective gimbals between pairs of hard metal points 70 adjustably mounted in the uprights thereof (FIG. 14). The respective pairs of points engage in turn in conical sockets formed at the opposed ends of hard metal cylinders 72 disposed there opposite in the respective beams. The respective trigger devices 66 (FIGS. 5 and 6) comprise L-shaped triggers 74 which have stops 76 upstanding about the horizontal legs thereof, and which are slideably engaged in the respective housings crosswise of the rack and the trough, with coiled springs 78 caged about the horizontal legs thereof, between the stops and the right-hand endwalls of the housings in FIGS. 5 and 6, to yieldably bias the respective triggers in the relatively left-hand directions thereof. The triggers also have conical detents 80 in the upper sides of the relatively right-hand ends thereof, which engage with wide-handled screws 82 on the respective balance beams corresponding thereto, to releasably detain the rotary actuators of the respective beams against movement in the downward direction thereof during the initial phase of the fill operation.

Figure 4:
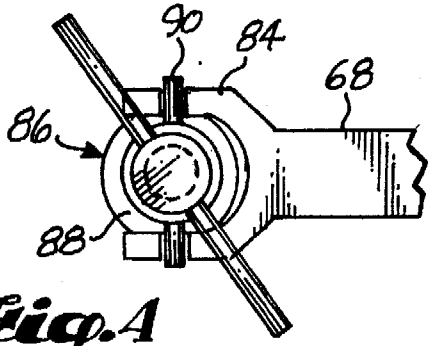
FIG. 4 is a plan view of the valve closure device from above.
Figure 3:
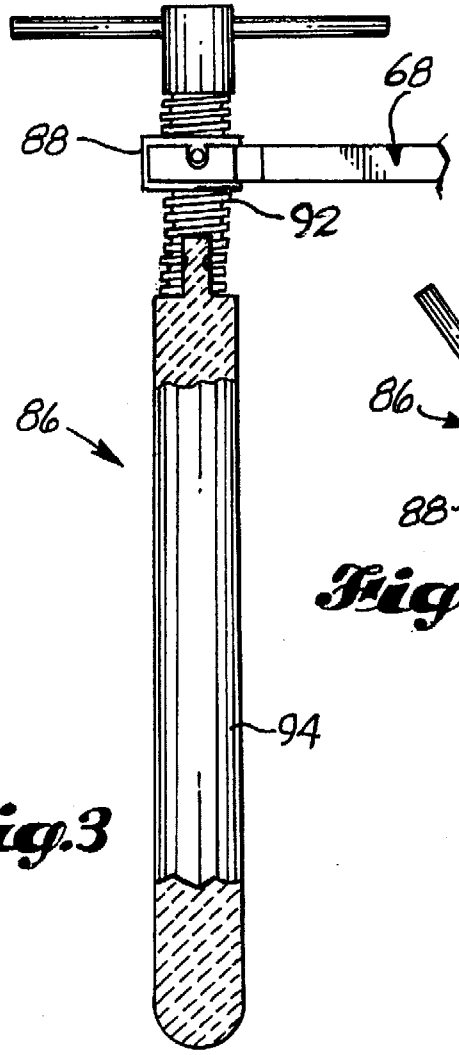
FIG. 3 is an elevational view of one the valve closure devices used in the assembly.

The respective balance beams 68 have a rectangularly cross sectioned built up construction which is solid at the right-hand outboard end portions thereof in FIG. 1, and slotted at the left-hand outboard end portions thereof in FIG. 1. The beams are seated in the respective gimbals 64 corresponding thereto, moreover, so that the left-hand outboard end portions thereof cantilever above the left-hand open areas of the cavities, whereas the right-hand outboard end portions of the respective beams cantilever above the trough and the respective downspouts 36 depending therefrom. The right-hand outboard end portions are also equipped with yokes 84 at the ends thereof, and the yokes in turn have the respective valve closure devices 86 of the assembly pivotally suspended therefrom to depend in the respective downspouts therebelow, and in loose engagement with the nozzles 46 at the bottoms thereof for purposes of being reciprocated between variable positions in which the molten metal in the downspouts is admitted to the respective cavities there-below at variable flow rates commensurate with the respective positions. The respective yokes 84 are also adapted so that the respective valve closure devices 86 are removably mounted on the yokes. As seen in FIGS. 3 and 4, the respective yokes have grooves in the tops thereof, along diameters coincident with the vertical axes of the downspouts corresponding thereto, and threaded nuts 88 with pairs of diametrically opposed trunnions 90 thereon, are saddled in the respective grooves at the trunnions so as to be removable from the respective yokes, but nevertheless have a limited amount of rotary action available to them about the axes of the trunnions. The nuts 88 in turn have threaded rods 92 threadedly engaged therein, with sockets in the bottoms thereof, and cross bars at the tops thereof, and suspended on the rods, coaxial therewith, are elongated valve closure pins 94 with reduced diameter necks at the tops thereof which insert in the sockets of the respective rods and are secured to the rods by pairs of set screws on opposing sides thereof. The bottoms of the pins are hemispherical to complement the insides of the nozzles 46 of the downspouts, and the pins 94 are made of a ceramic material and sized so that when inserted in the nozzles, annuli are formed between the respective pins and the respective nozzles, through which the molten metal can escape to the cavities therebelow. However, when sufficiently downwardly inserted in the downspouts to bottom at the openings 48 of the nozzles, the pins terminate the flow of molten metal altogether. The extent to which the pins extend into the nozzles otherwise, and throttle the flow therethrough, depends of course, on the elevations of the right-hand ends of the respective balance beams, and the nuts 88 mounted thereon, as well as the combined lengths of the pins and rods below the nuts. These lengths can be varied by rotating the respective rods 92 in the nuts, up or down, using the bars as handles for the purpose.

The slots in the left-hand outboard end portions of the respective balance beams have bulkheads arranged crosswise thereof. One bulkhead 96 in the slot of each beam is slidable lengthwise of the respective slot, then releasably attachable to the beam, to form an adjustable counterweight for the left-hand outboard end portion of the respective beam. Another is fixed to the outboard end of the slot to carry a screw for fine tuning the ballast provided by the counterweight; and a third 98 is pivotally mounted in the slot, inboard of the first, with a hole therethrough for the sensor device 99 of the respective beam. An elongated rod 100 with a float 102 at the bottom thereof is fixedly engaged in the hole with set screws to extend both above and below the beam on an imaginary line which is vertically upstanding in the cavity therebelow, and adjacent the center of the open area at the top thereof, when the respective beam is horizontally disposed. The float 102 is broadly dimensioned, flanged, and sufficiently ballasted to yieldably bias the left-hand outboard end portion of the respective beam to rotate in the direction of the cavity and the relatively lower end opening 22 thereof. The rod 100 is sufficiently elongated below the beam, moreover, that when the assembly is devoid of molten metal and the rack 56 is in the bottom-most position thereof, the rod and float depend well below the relatively lower end opening of the cavity. The corresponding pin 94 on the right-hand outboard end portion of the beam engages in the downspout therebelow, meanwhile, but well above the closure position at the opening of the nozzle 46 therein.

The upper end portion of the rod 100 above the beam, has an elongated scale 104 attached upright thereon to cantilever outboard of the respective rod and cooperate with a molten metal height indicator 106 mounted abreast thereof on a post 108 upstanding on the shelf adjacent the outside edge thereof. In addition, each counterweight 96 has a thumbscrew thereon with which to loosen and tighten it at its respective positions on the beam corresponding thereto.

The fourth bulkhead 110 at the inboard end of the slot in each beam is also fixed, and has one of the wide-handled screws 82 threaded downwardly therethrough, with a conical tip 112 at the bottom thereof. The bulkhead 110 is positioned on the respective beam to engage the screw in the detent 80 of the trigger 74 positioned therebelow, when the beams are raised and the valve closure devices 86 are prepositioned before the commencement of the casting procedure, as shall be explained more fully hereinafter. The depending length of each screw below the bulkhead 110 can be adjusted, moreover, by screwing the shank of it up or down in the bulkhead using the handle 113 on the screw. Each such adjustment operates in turn to vary the arc length of the angle swung by the respective beam from the closure position of its pin 94 in the nozzle of the corresponding downspout, when the tip 112 of the screw engages in the detent 80 of the trigger corresponding thereto. Furthermore, when the tip of the screw is engaged in the detent, the angle of the corresponding beam dictates the extent to which the pin 94 thereof is inserted downwardly in its downspout, and therefore, the extent to which the pin throttles the valve opening of that nozzle. There is, therefore, an adjustment possible at both ends of the respective beams for purposes of prepositioning the valve devices, as shall be explained.

The respective bottom blocks 12 have conventional recesses 114 in the tops thereof, and are sized to telescopically engage in the relatively lower end openings 22 of the cavities in the casting apparatus. Before the commencement of each casting procedure, the elevator means 10 in the pit are activated to raise the blocks into engagement with the respective cavities thereabove, and thereby form sumps 116 within the respective cavities for the temporary retention of molten metal therein. Moreover, the left-hand outboard end portions of the respective beams in FIG. 1 are raised to space the respective sensor devices 99 above the tops of the blocks, and the respective screws 82 on the bulkheads 110 of the beams are advanced, or retracted, to positions in which, when engaged with the triggers 74 therebelow, will leave the balance beams in angular orientations at which the respective valve devices 86 suspended therefrom will assume positions within the nozzles of the respective downspouts therebelow at which they will admit the molten metal to the respective sumps 116 corresponding thereto in amounts that are varied commensurate with the distance lying along the line of valve openings between each of the valve openings 48 and the open end 26 of the trough, so that as the surfaces of the respective molten metal columns formed in the respective sumps during the initial phase of the fill operation in the casting procedure to follow, approach the sensor devices corresponding thereto, the surfaces will establish a state of substantial equilibrium with one another at an intermediate elevation between the tops of the blocks and the start-up elevation for the casting operation. See FIG. 7. To engage the triggers 74 with the respective screws 82 corresponding thereto, however, the triggers had to be advanced against the bias of the springs 78 acting thereon, and as a consequence, when the surfaces of the respective molten metal columns in the sumps reach the intermediate elevation, the sensor devices 99 and the beams from which they are suspended, will be lifted by the surfaces and at the same time, the springs 78 of the respective trigger devices will drive the triggers into the retracted positions thereof, thus freeing the respective sensor devices and beams for control of the admission of the molten metal to the cavities at the respective valve openings corresponding thereto. See FIG. 8.

Figure 8:
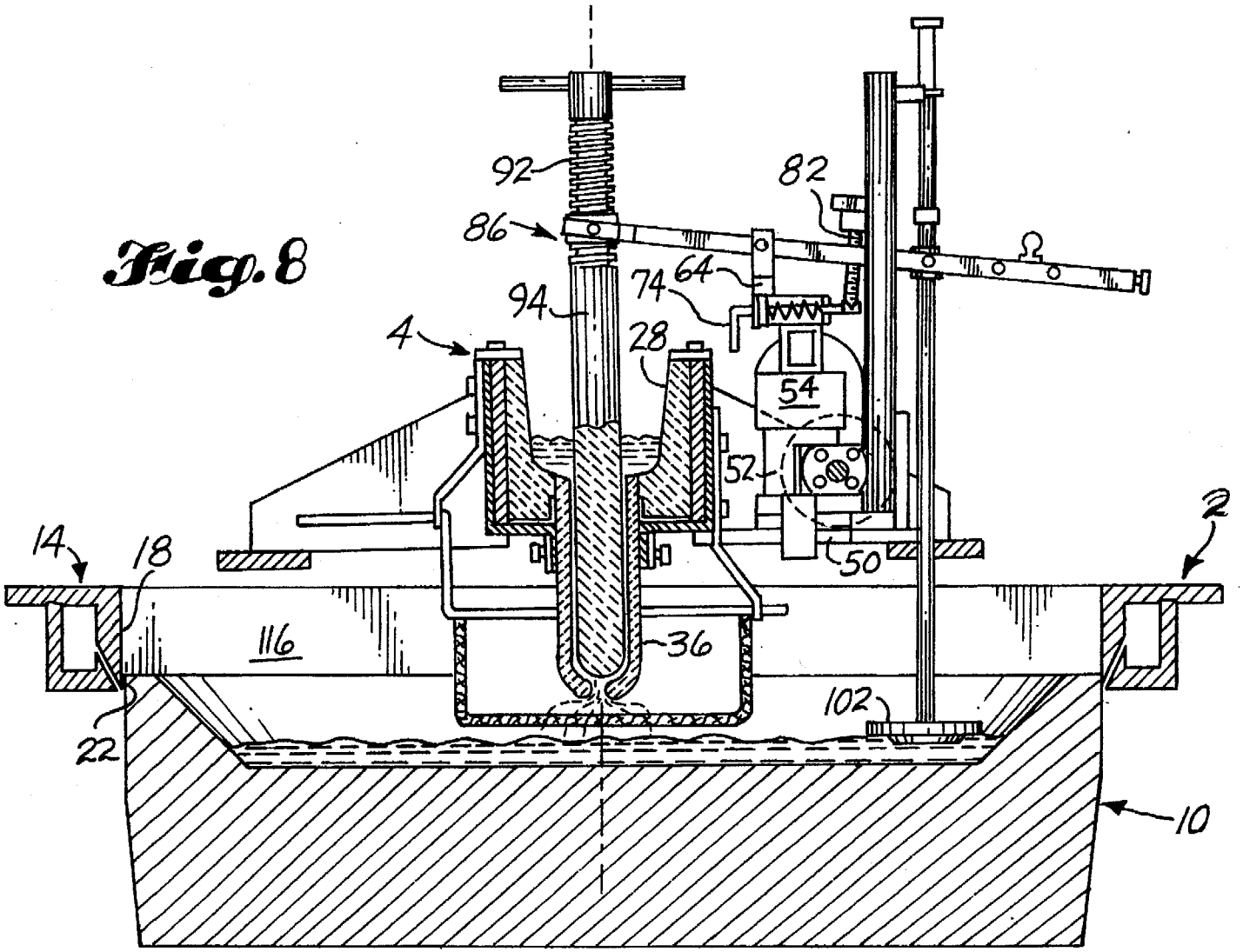
FIG. 8 is a similar view through the casting apparatus at a point in time wherein after the fill operation has been commenced, the surfaces of the respective molten metal columns formed in the sumps during the initial phase of the operation, have established a state of substantial equilibrium with one another at an intermediate elevation between the tops of the blocks and the start-up elevation for the casting operation, and the balance beams have become operable to transmit to the respective valve closure devices thereon, input signals which are both a function of the vertical distance between the rack and the plane with which the relatively lower end openings of the cavities coincide, and a function of the vertical distance between the pivotal suspension points, i.e., the signal generation points, of the respective contact sensors and the surfaces of the respective molten metal columns therebelow.
Figure 9:
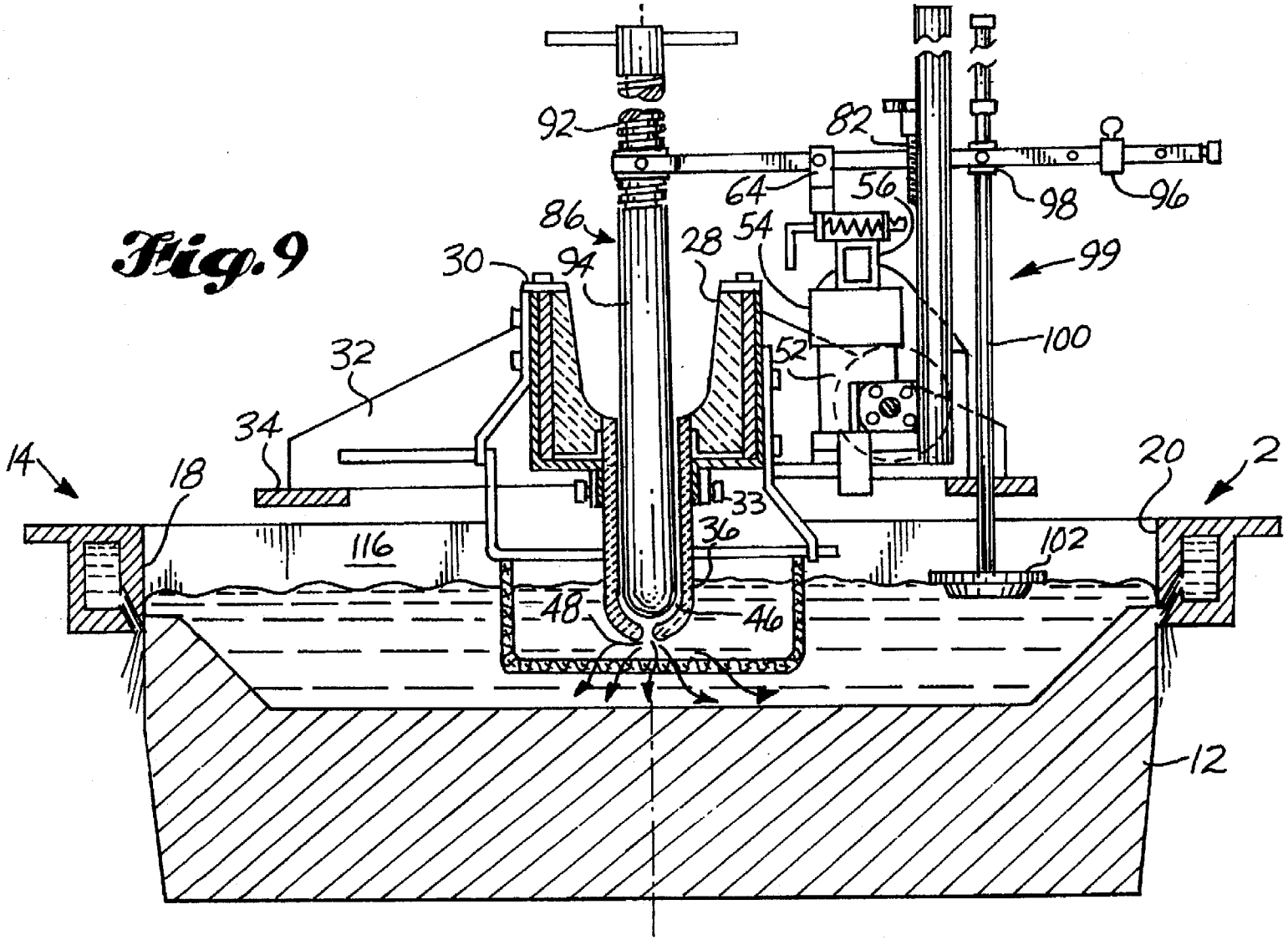
FIG. 9 is a third such view through the casting apparatus at a point in time wherein after the rack had been elevated both to dictate the rate at which the surfaces of the respective molten metal columns in the sumps continued to escalate up the axes of the cavities from the intermediate elevation to the start-up elevation and to render the input signals transmitted to the respective valve closure devices by the rotary actuators in the respective balance beams substantially consistent with that rate, now the bottom blocks for the respective cavities are instructed to begin with drawing reciprocating relatively downwardly from the casting apparatus to commence the casting operation.

At this point, moreover, the rotary actuators 118 constituted by the left-hand outboard end portions of the respective beams 68 in FIG. 1 and the gimbels 64 corresponding thereto, each become a control device which is interconnected with the respective sensor device 99 corresponding thereto, and the respective right-hand outboard end portion of the beam and the linear portion of the rack 50 corresponding thereto, to transmit to the respective right-hand outboard end portion of the beam, and thus the valve closure device 86 thereon, input signals which will vary the position of the respective valve closure device, both as a function of the vertical distance between the gimbal and a reference plane such as the plane with which the relatively lower end openings 22 of the cavities coincide, and as a function of the vertical distance between the bulkhead 98 in the slot of the respective beam, i.e., the signal generation point of the respective sensor device 99, and the surface of the respective molten metal column there-below. However, as seen in FIG. 8, were the gimbals 64 to remain at the elevation in which they are shown, relative to the plane of the relatively lower end openings of the cavities, the surfaces of the respective molten metal columns taking on still higher elevations in the sumps thereafter, would quickly elevate the floats and in turn the signal transmission points 98 of the respective sensor devices, to the extent that the pins would bottom out in the nozzles in the respective downspouts, and close off the flow of molten metal therethrough.

According to our invention, therefore, when the surfaces of the respective molten metal columns reach the intermediate elevation and the beams become operational, we activate the motor 61 for the rack 56 and drive the rack upwardly at a speed designed to raise the gimbals 64, and the opposing outboard end portions of the beams in turn, at a rate adapted on one hand, to dictate the rate at which we want the surfaces of the respective molten metal columns to continue to escalate up the axes of the cavities in the direction of the start-up elevation from the intermediate elevation, and on the other hand, to raise the elevation of the signal transmission points 98 of the respective sensor devices at a rate sufficiently commensurate therewith to render the input signals transmitted to the respective right-hand outboard end portions of the beams by the rotary actuators 118 opposed thereto, substantially consistent with the rate we have imposed on the surfaces themselves. In this way, the surfaces can be made to approach the start-up elevation in a relatively quiescent condition and at a speed entirely of our own choosing. See FIG. 9.

Furthermore, at the start-up elevation, we have several options available to us. We may deactivate the motor 61 and cease raising the rack 56, and at the same time, activate the elevator means 10 in the pit, to lower the blocks and begin the casting operation at an operating elevation corresponding to the start-up elevation. Or we may continue to elevate the rack after activating the elevator means in the pit, to raise the elevation of the surfaces above the start-up elevation, and then reverse the motor for the rack so as to lower the elevation of the surfaces to an operating elevation of our choice, after overfilling the cavities. See FIG. 10 in this connection wherein it will be seen that the blocks 12 have been lowered below the casting apparatus, the discharge of liquid coolant has begun, and yet the surfaces of the respective molten metal columns are well above what will become the operating elevation for the casting operation once the rack is lowered to lower the surfaces in turn. In fact, having completed the fill in this fashion, the surfaces may be lowered to elevations in which they surround the valve openings 48 of the nozzles, but are disposed at an elevation consistent with "low head" casting practice.

As explained earlier, moreover, the rack 56 may also be used to relocate the operating elevation for the casting operation, when the casting speed is changed from one portion of the operation to another. And of course, the rack may be used to relocate the elevation of the surfaces even when a casting operation is conducted at one speed, such as to raise the surfaces to a higher operating elevation after casting has been commenced at a relatively lower start-up elevation.

For a procedure to be entirely successful, the floats 102 must have the same geometry, and must be yieldably biased downwardly into the molten metal columns at the same downward force. That is, the assembly must be dynamically balanced before each procedure is begun.

A further feature of our invention lends itself to assuring that there is such a dynamic balance in the assembly. As indicated, the valve closure devices 86 may be lifted away from the yokes 84 prior to a casting procedure, and preheated before being returned to the yokes for the procedure itself. However, the preheating step risks that the arc lengths given the beams in calibrating the bias on them, will be lost when the valve closure devices are returned to the yokes, and in any event that the arc lengths will be altered from one casting procedure to the next, when the valve closure devices are repeatedly removed, preheated and returned to the yokes.

FIGS. 11–19 show a modification designed to enable us to check the accuracy of the respective arc lengths from one casting procedure to the next, or in any event, to quickly restore them to a desired level of accuracy. They also show a different trigger device 119 and two additional modifications which enable us to incorporate an electronic controller 120 into the assembly for the overall control of the various operations in each casting procedure, including aborting a casting procedure in any one or more of the cavities when desired. However, the arc length calibration feature will be explained first, it being understood in the meantime that the trigger 121 in the device 119 operates in the same fashion as the trigger 74 in FIGS. 5 and 6 insofar as prepositioning the valve devices is concerned.

Figure 6:
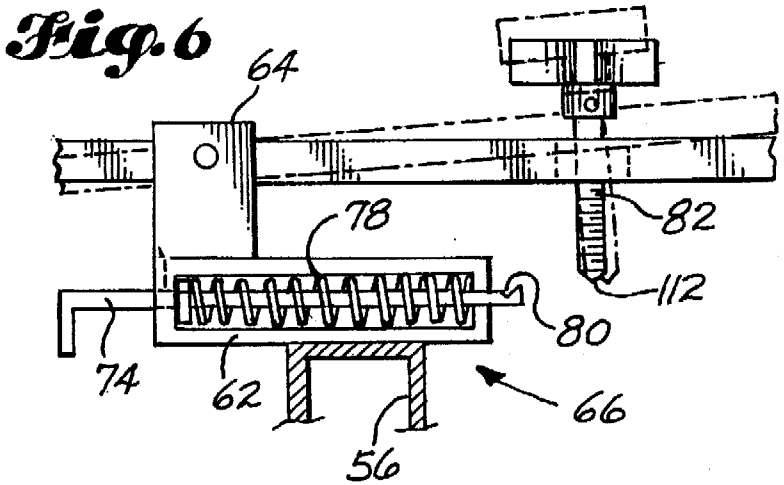
FIG. 6 is a similar view showing the manner in which the trigger device is disengaged from the respective rotary actuator of the beam corresponding thereto.
Figure 5:
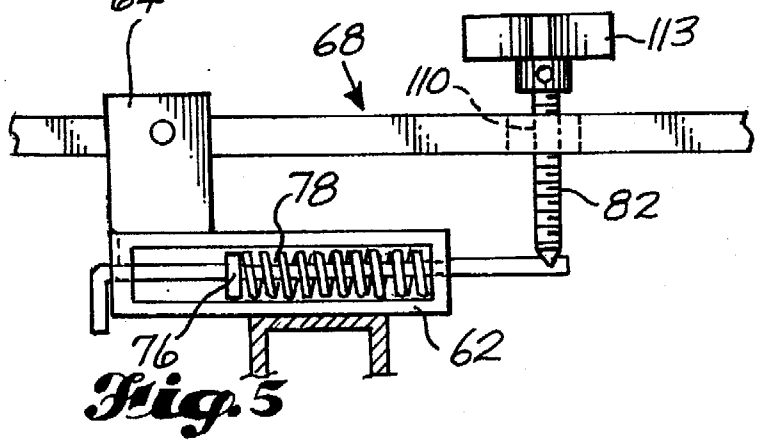
FIG. 5 is a part cross sectional elevational view of one of the trigger devices which are engaged with the respective balance beams on the rack to releasably detain the respective rotary actuators thereof against the bias thereon until the surfaces of the respective molten metal columns therebelow engage the contact sensors in the assembly to disengage the trigger devices from the respective rotary actuators.
Figure 7:
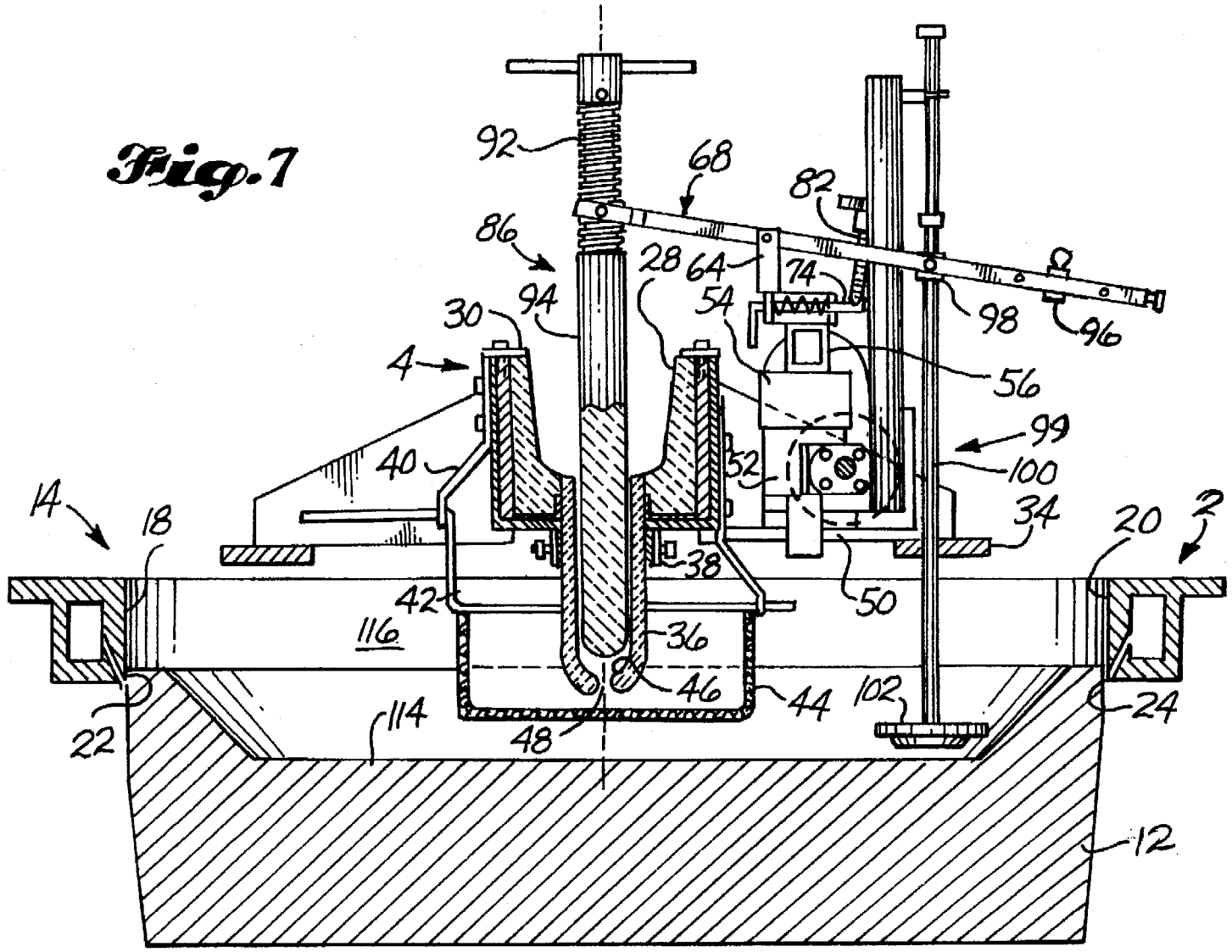
FIG. 7 is a part cross sectional elevational view, through the casting apparatus at one casting station in the assembly when prior to the commencement of the fill operation, the bottom blocks have been telescopically engaged in the relatively lower end openings of the mold cavities in the casting apparatus to form the respective sumps therein, the valve closure devices have been prepositioned, and the balance beams have been lifted and engaged with the trigger devices to space the respective contact sensors above the tops of the blocks forming the respective sumps therebelow.

Referring now then to FIGS. 11–16 and 19 in particular, it will be seen that the bulkheads 122 in the beams have pairs of screws 124 and 126 threadedly engaged therein, to be extended downwardly of the respective beams, or retracted upwardly thereof. The right-hand screws 126 in each pair of screws are downwardly extended to greater lengths than the left-hand screws 124, moreover, and all of the right-hand screws are extended the same length to serve as a reference with which to confirm or recalibrate the lengths of the valve closure devices 86 after they have been preheated and returned to the yokes. That is, after the beams have been calibrated as to bias, and after the valve devices have been removed, preheated and returned to the yokes, but before the left-hand screws 124 of the respective bulkheads have been engaged with the triggers 121 of the respective trigger devices 119, to preposition the valve closure devices, the triggers 121 are extended to the far right and engaged with the tips of the right-hand screws 126, either to confirm the lengths of the valve closure devices, or to enable one or more of the valve devices to be adjusted in length at the handles thereof, so that when the preliminary procedure is completed, all bottom the same in the nozzles of the downspouts therebelow, before the trigger engagement operation of Figures 5–7 is undertaken. Once all bottom the same in the nozzles, the respective triggers are released from the right-hand screws, and are withdrawn under the bias thereon to positions in which they underlie the tips of the left-hand screws 124. They are then engaged with the left-hand screws, at the differing lengths thereof to give the respective beams the arc lengths needed to vary the inflow of metal to the respective cavities during the initial phase of the fill operation. Afterward, when a second casting procedure is undertaken, the triggers can be engaged once more with the right-hand screws to confirm or recalibrate the setting of the valve closure devices, and again before using the left-hand screws to preset the beams for the fill operation. The same is also true for each casting procedure undertaken thereafter.

Turning now to the use of the electronic controller 120 in the assembly, the triggers 121 shown in FIGS. 11–19 are each housed in a case 128 having two parts 130 and 132 (FIG. 16) which are superposed one on top of the other to define an elongated slot 133 (FIG. 13) therebetween which slidably accommodates the respective trigger. The upper surface of the lower part 132 has an elongated groove 134 therein defining the bottom and sides of the slot. The upper part, meanwhile, defines the top of the slot, but both the bottom of the groove and the opposing lower surface of the upper part, have elongated recesses 136 and 138 therein which oppose one another vertically of the slot. A pair of short posts 140 and 142 is upstanding in the groove 134, one 140 at the left-hand end of the recess 136, and the other 142 adjacent the nearer sidewall of the groove, and more midway of the same. The trigger 121 itself is elongated, flat and rectangularly cross sectioned, and has a handle flanged to the left-hand end thereof. An oblong recess 144 adjacent the right-hand end of the trigger provides a detent for the engagement of the trigger with either of the screws 124 and 126. An elongated slot 146 in the body of the trigger, more adjacent the left-hand end thereof, provides means whereby a coiled spring 148 can be caged within the recesses 136 and 138, to yieldably bias the trigger to the retracted position thereof when it disengages from the screws. The spring 148 is an elongated coiled spring with hooks at its respective ends. The left-hand hook is engaged about the post 140 in the recess of the lower part, and the right-hand hook is engaged in a hole 150 in the body of the trigger adjacent the right-hand end of the slot therein. See FIGS. 11–13 and 19. An elongated cutout 152 in the proximal sidewall of the trigger provides accommodation for the additional post 142 in the groove 134 so that when the trigger is reciprocated in the slot, the post operates as a stop, preventing it from escaping from the slot at either end thereof.

Figure 17:
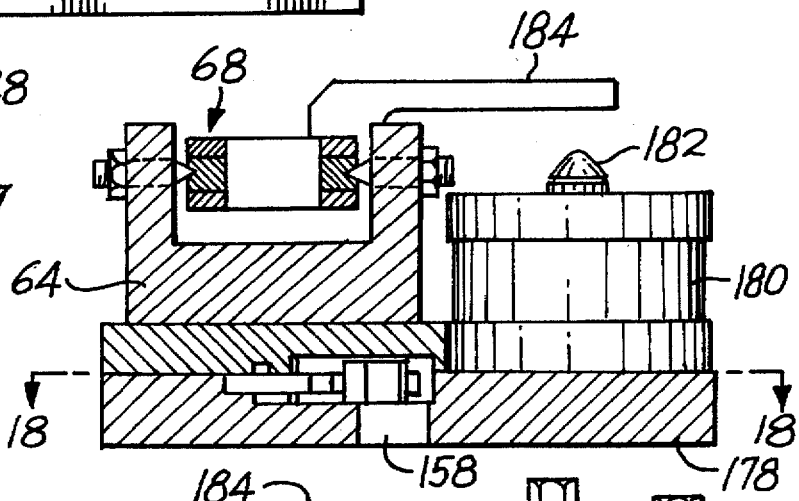
FIG. 17 is a cross sectional view of the added features along the line 17—17 of FIG. 15.
Figure 19:
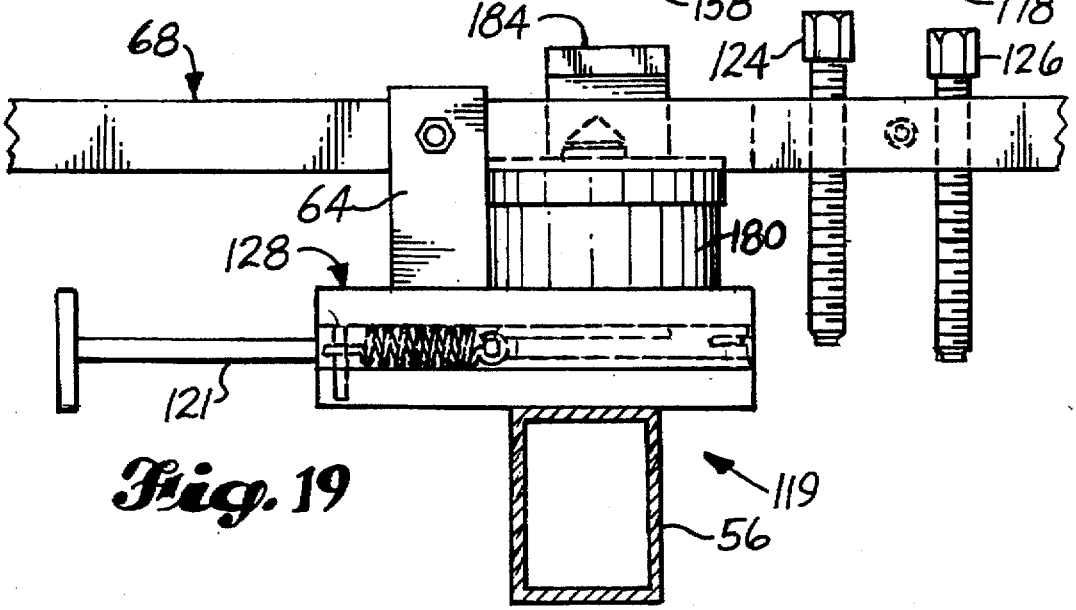
FIG. 19 is a part cross sectional view along the line 19—19 of FIG. 18.

At the interface between the two parts 130, 132 of the case 128 and laterally offset from the slot 133, the opposing surfaces of the two parts have generally rectangularly shaped recesses 154 and 156 therein, with head-like extensions at the left-hand ends thereof. In addition, the recess 154 in the surface of the lower part has an oblong hole 158 in the right-hand end thereof, and the hole opens to the underside of the case, as best seen in FIG. 17. When the two parts are sandwiched together to form the case, a microswitch 160 with a pair of prongs 162 on one end thereof, and a button contact 164 with an opposing leaf spring contact 166 outstanding on the relatively inboard side thereof, is screwed onto the bottom of the recess 154 and captured in the chamber formed by the recesses, there being bolts and threaded holes in the four quadrants of the respective parts for purposes of securing them together in the sandwich.

The microswitches 160 are electrically interconnected with the controller 120 through leads 168 (FIG. 1) with female receptacles (not shown) thereon which are passed upwardly through the holes 158 and engaged with the male prongs 162 of the respective switches before the switches are mounted in the recesses. Meanwhile, the leaf spring contacts 166 of the respective switches have rollers 170 on the remote ends thereof which are biased by the leaf springs on said contacts to ride along the right-hand sidewalls of the triggers. See FIG. 18. The sidewalls have elongated cutouts 172 therein, however, and the cutouts are positioned to receive the rollers when the respective triggers are extended for engagement with the left-hand screws 124 on the beams. When the rollers so engage with the cutouts under the bias of the leaf springs of the contacts, the contact between the leaf spring contacts and the button contacts 164 on the bodies of the switches is lost. However, when the triggers are returned to the retracted positions thereof in the cases, under the bias of the springs 148 therewithin, the rollers 170 once again return to the sidewalls of the triggers against the bias of the leaf springs. This restores contact between the leaf spring contacts and the button contacts, and accordingly, the switches can be said to have two positions, one when contact is broken and the other when contact is restored.

The controller 120 is electrically interconnected with the motor 61 for the rack through a further lead 174, and when the left-hand screws 124 are engaged with the respective triggers 121 at the detents 144 thereon, the open position of the switches with the rollers 170 in the cutouts 172 tells the controller that the floats are raised so that the casting procedure can be commenced. The controller may then introduce molten metal to the entry end 26 of the trough to begin the procedure, and subsequently, when the screws 124 and triggers 121 are disengaged from one another by the rising metal in the cavities, the closed position of the switches with the rollers 170 on the sidewalls of the triggers tells the controller that the beams are in control of the fill operation and that the motor can be operated to elevate the gimbals 64 and enable the fill operation to remain under the control of the beams.

A still further lead 176 between the controller and the elevator means 10 for the platen, enables the controller to activate the elevator means when the surfaces of the respective molten metal columns reach the start-up elevation for the casting operation.

Figure 10:
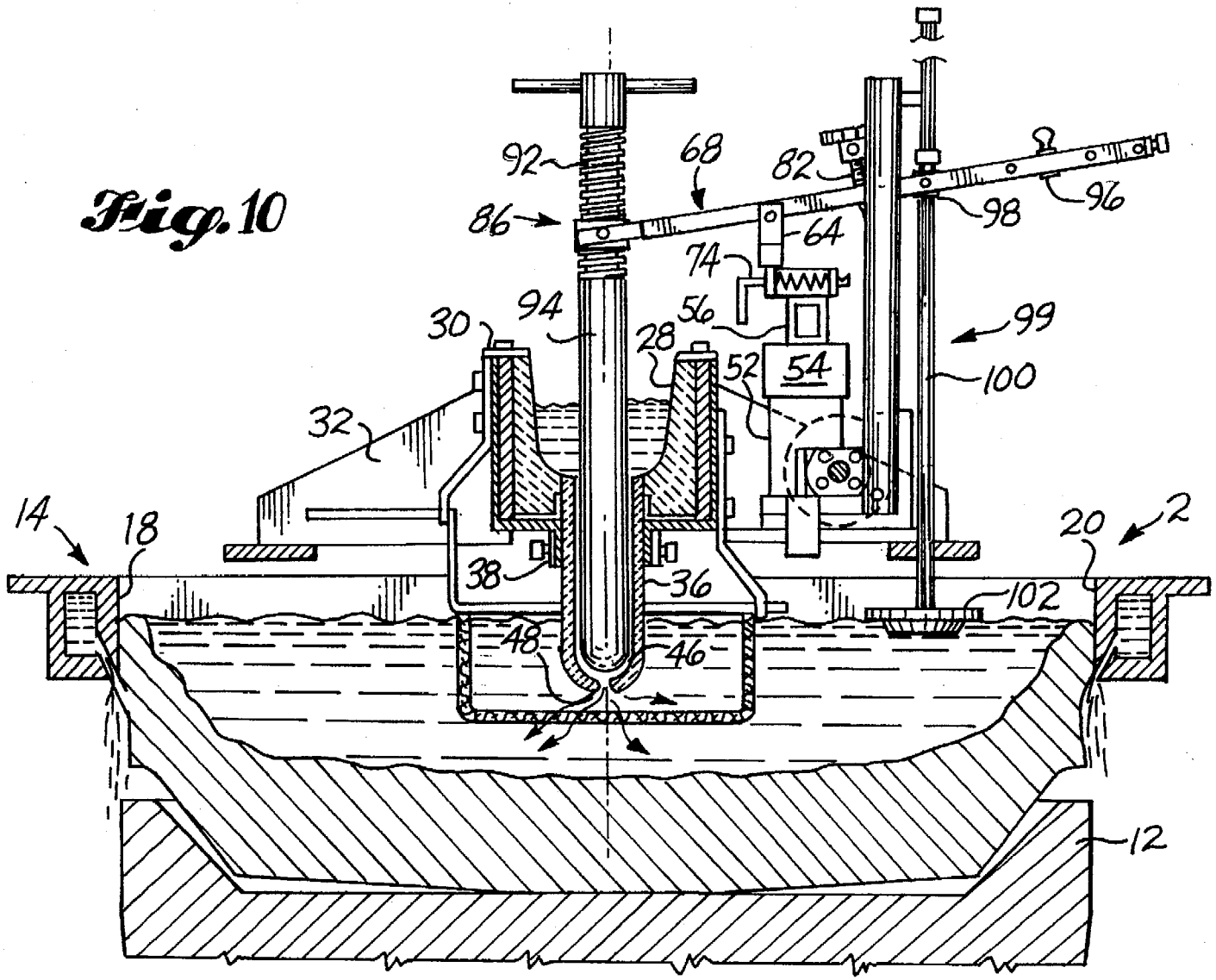
FIG. 10 is a fourth such view through the casting apparatus at a point in time wherein the reciprocation of the rack had been continued to overfill the respective cavities during the initial stage of the casting operation, but the direction of reciprocation of the rack has not been reversed as yet to return the surfaces of the respective molten metal columns to the operating elevation for the casting operation.
Figure 12:
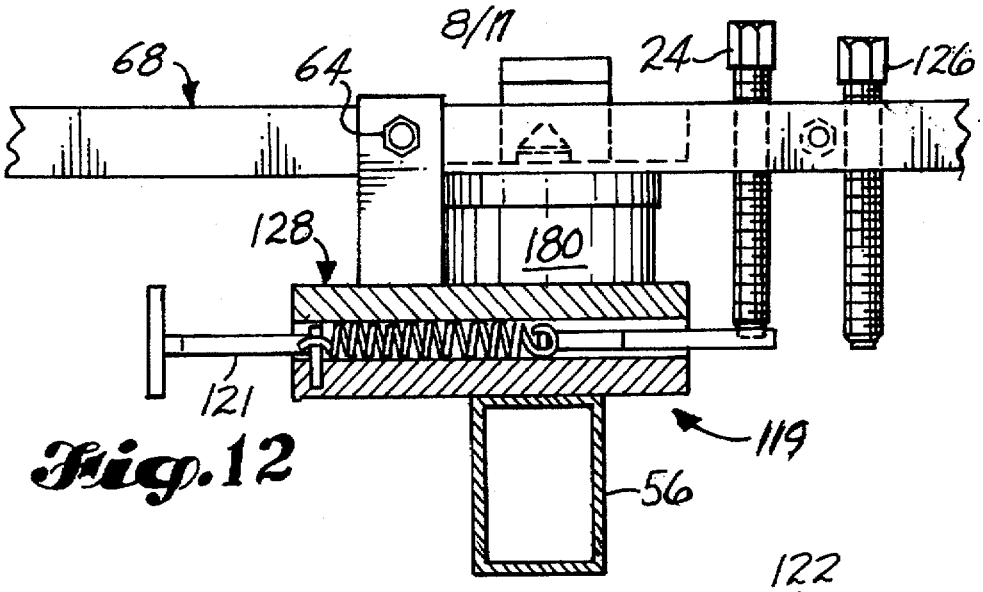
FIGS. 11–13 are enlarged part cross sectional elevational views of a trigger device modified for recalibrating the angular position of the rotary actuators in the respective balance beams after the valve closure devices thereon have been removed, preheated, and then returned to the respective beams for the casting procedure; and also showing a servo mechanism with which the casting procedure at any one or more of the respective casting stations can be aborted at any time during the casting procedure.
Figure 11:
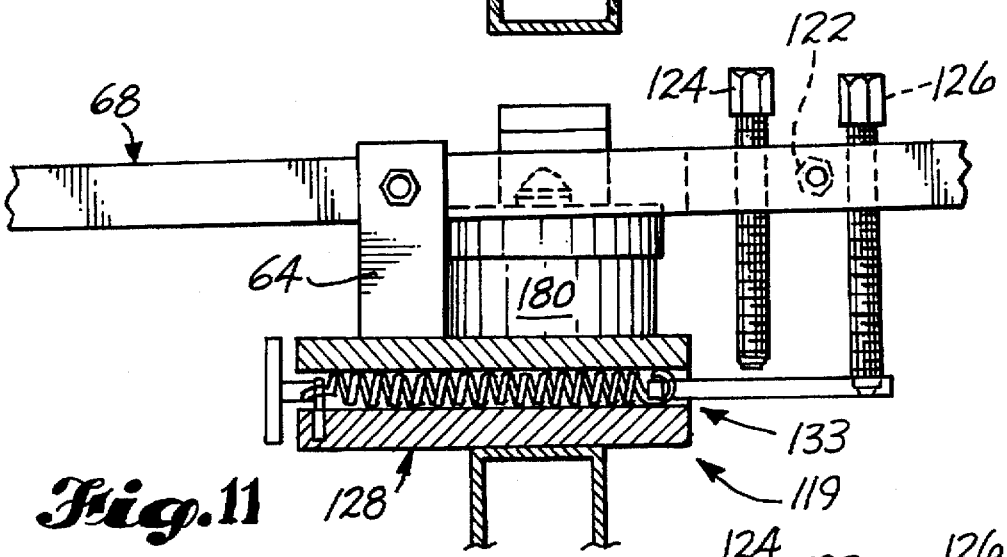
Figure 13:
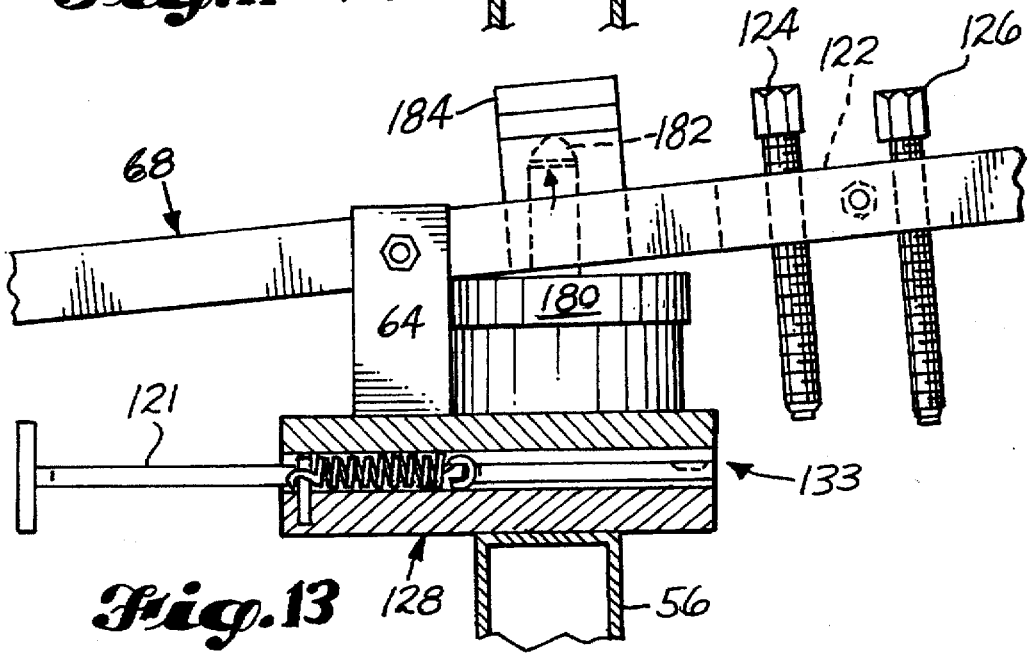

Given a programmable controller, the controller 120 may also provide for overfilling the cavities, as in FIG. 10, and for any other variation in the use of the invention which is desired for the respective fill and casting operations. Likewise, the controller may provide for changing the speed at which the platen is lowered relative to the casting apparatus, and restarting the motor to relocate the gimbals at a level in which the beams will control the molten metal flow commensurate with the new speed. So too, the controller 120 may provide for the gimbals being located at different elevations from one casting procedure to another, when the cross section of the respective cavities is changed between casting procedures.

With each procedure fully automated in this fashion, we may sit at a console (not shown) and monitor the entire procedure through the controller. Moreover, should we choose to abort a procedure, or to terminate it prematurely, or to terminate the flow to one or more cavities, we may do so through a further feature of the invention shown in FIGS. 11–13. As seen in those Figures and in FIGS. 14–19 as well, the gimbals 64 are mounted on the housings 128 of the respective trigger devices 119 adjacent the left-hand ends thereof. The remote sides of the housings have platforms 178 extending outboard therefrom, on the rack, and pneumatic cylinders 180 are installed upright on the platforms with props 182 at the centers thereof to be elevated by the cylinders. Additionally, between the gimbals and the bulkheads 122 for the screws 124 126 on the right-hand outboard end portions of the beams, the beams have L-shaped tongues 184 cantilevered laterally outwardly therefrom above the props 182 of the pneumatic cylinders. The controller 120 has a lead 185 to a signal conversion device (not shown) which is interposed between it and the respective cylinders, and pneumatic transmission lines 186 are interposed between the conversion device and the respective cylinders to enable us to abort a casting procedure, or the flow to one or more cavities, when we choose to do so at the console. That is, by activating the appropriate cylinder or cylinders 180 to elevate the corresponding prop or props 182 into abutment with the corresponding tongues 184 on the beams, we bias the beams to rotate against the bias of the ballast in the floats, and in the direction of the valve closure devices, to close the corresponding nozzles to flow therethrough.

The rack 56 is hollow to enable most of the respective electrical and pneumatic leads to be passed therethrough from one casting station to the next.

In FIG. 20, we have illustrated an electro- pneumatic version of our invention which employs an electronic controller 188 and electrically powered non-contact sensors 190 on the rack. The version is shown in the context of a single casting station, but it will be understood that a multiplicity of stations is commonly employed, and also, regardless of the number, only the single programmable logic controller (PLC) shown at 188 is needed to service them. Now, however, the valve closure device 192 for the downspout 194 at each station is suspended from a balance beam 196 which is pivotally mounted in a gimbal 198 supported upright on a shelf block 200 that is secured to one side of the trough 202 at the station and interconnected with the shelf blocks at the other stations by a hollow wireway 204. Though ballasted, each beam 196 is biased to close the nozzle 206 of the respective downspout corresponding thereto, and a bellows motor 208 is interposed between the shelf block for the beam and the relatively left-hand outboard end portion thereof which is cantilevered over the trough and carries the valve closure device 192 for the respective nozzle. Furthermore, the sensor devices now take the form of inductive proximity sensors 190 which are fixedly suspended from a hollow rack 210 that is spatially offset from the wireway 204, but like the wireway, disposed on a parallel to the line of valve openings in the trough and the plane with which the relatively lower end openings 22 of the cavities 18 of the molds 14 in the casting apparatus 2 coincide. The rack is now supported, moreover, on machine jacks 212 which have their own reversible motors 214 at the bottoms thereof, and in addition, potentiometers 216 connected with the linear actuators or drivers thereof. The respective sensors 190 are suspended by hollow tubing 217, and are electrically connected by cables 218 through the hollow of the rack to separate electrical processing units 219 which are labeled as "sensor electronics" and convert the frequency signals from the respective sensors into surface elevation signals 220 which the electronic controller 188 can understand. The power for the respective sensors is supplied at 221 to the respective sensor electronics units thereof, and at the other side of Figure 20, the controller 188 is electrically interconnected at 222 with the potentiometers 216 on the actuators of the respective jacks, to receive the signals therefrom indicating the elevation of the respective actuators relative to the plane of the relatively lower end openings 22 of the cavities in the molds. The controller is also electrically interconnected at 224 with the motors 214 of the respective jacks, and at 226 with a user interface 228 for an operator of the assembly.

The controller 188 is electrically connected at 230 moreover, with a separate air pressure controller 232 at each casting station, wherein the controller's electrical signals are converted into corresponding pneumatic signals for the bellows motor 208 at that station. Pressurized air is supplied to the respective air pressure controllers at 234, and each air pressure controller uses the pressurized air to dictate fluid pressure signals 235 for the respective motor 208 thereof that reflect the electrical signals given it at 230. It also transmits them through what is now more of an "airway" than a wireway at 204, given that the signals 235 are pneumatic rather than electronic in character. Given the arrangement shown, moreover, the electronic controller 188 can sense the elevation of the rack drivers relative to the plane of the relatively lower end openings of the cavities, can receive and understand the respective signals from the sensors 190 indicating the elevation of the surfaces of the respective molten metal columns in the cavities, and with appropriate code, can compare and integrate the respective signals and transmit its wishes to the air pressure controllers for the bellows motors at the respective casting stations, and in addition, its wishes for the motors of the jacks for purposes of raising and lowering the rack.

Figure 21:
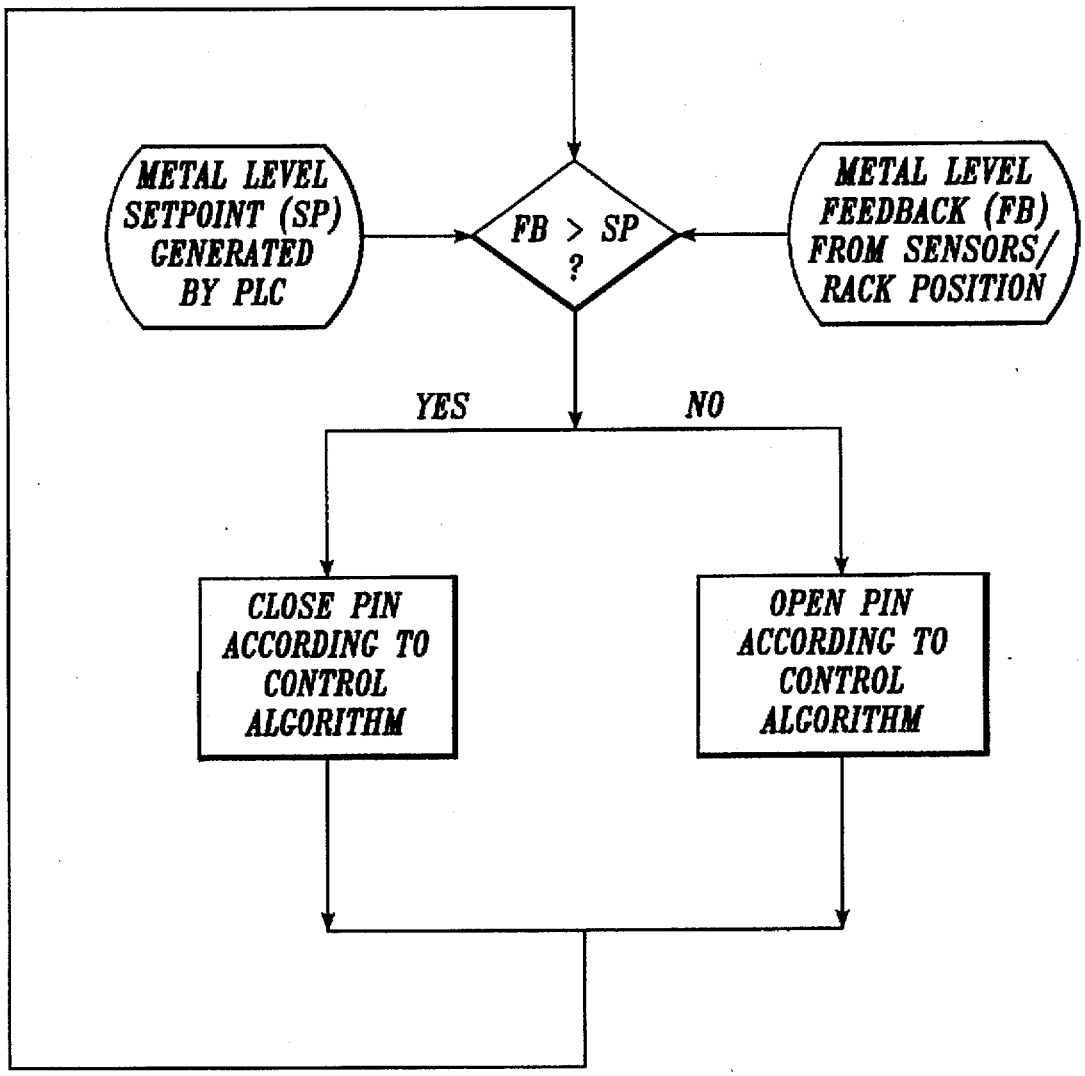
FIG. 21 is a schematic representation of one code used in the controller.
Figure 22:
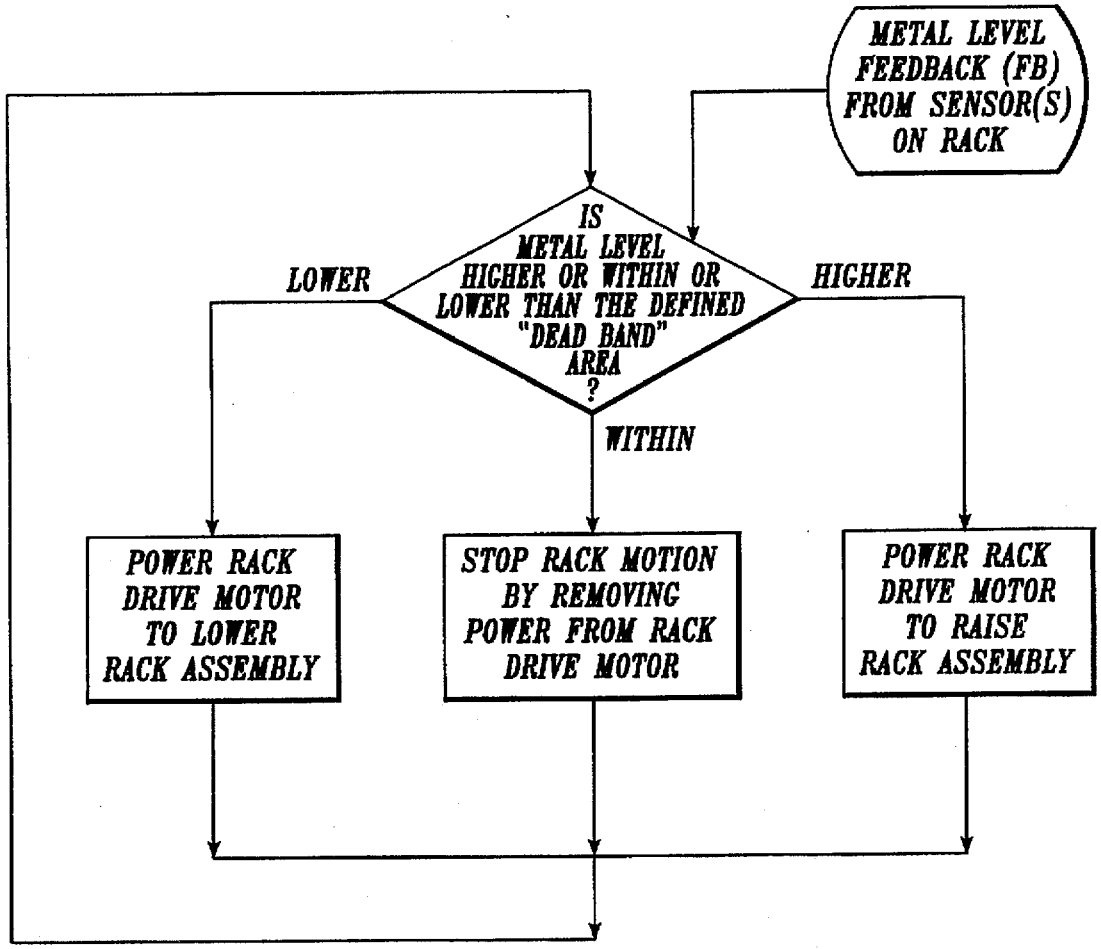
FIG. 22 is a schematic representation of another code which may be used with it in the controller.
Figure 23:
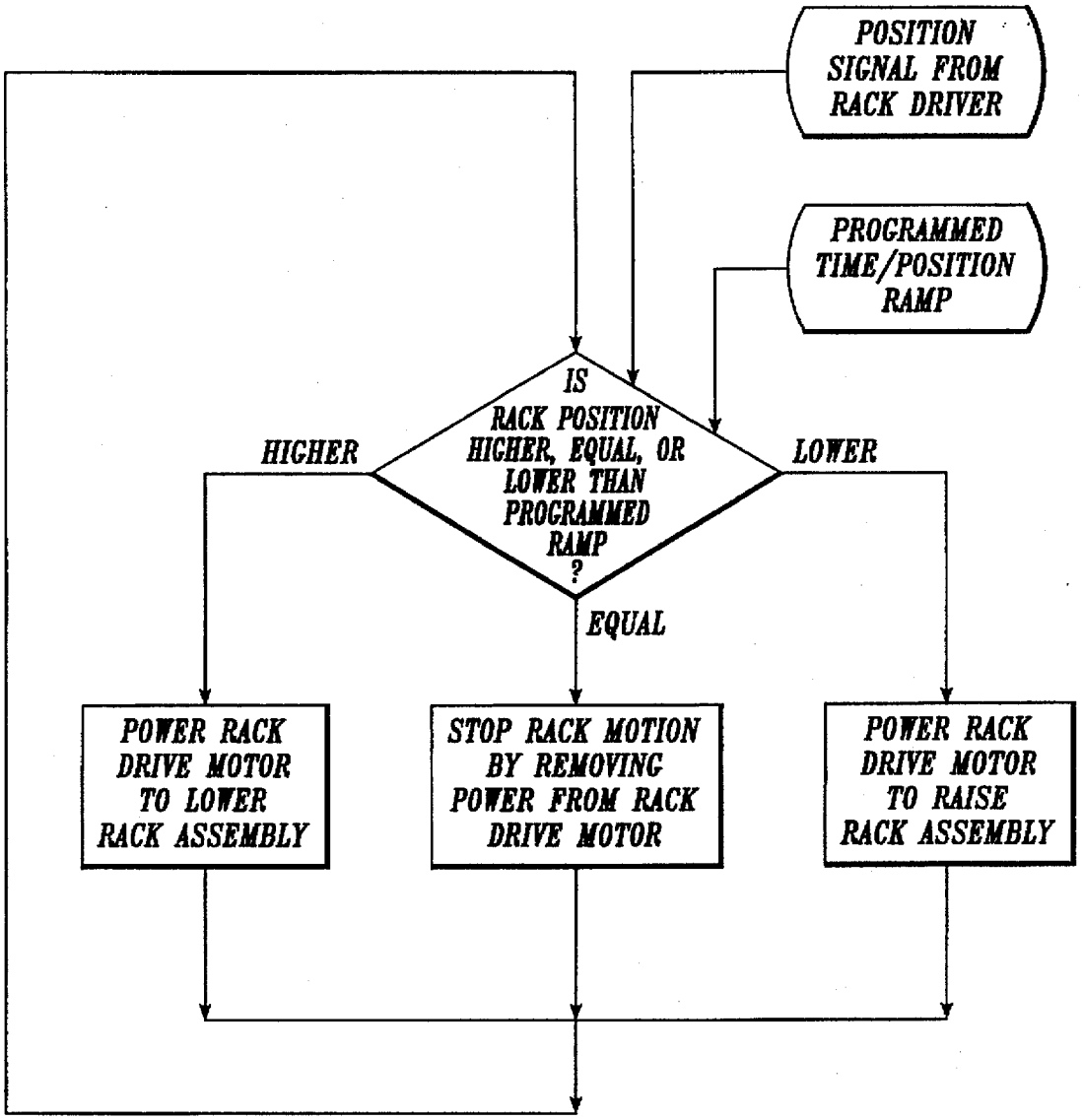
FIG. 23 is a similar representation of still another code which may be used with the first in the controller.

The codes for its transmissions to the air pressure controllers and its transmissions to the motors and actuators, i.e., the "driver" of the rack, are shown schematically in FIGS. 21–23. These show the codes for the casting procedure itself, however, and it should be mentioned in advance that before a procedure is undertaken, a calibration jig (not shown) is placed in each cavity, and programming (not shown) in the controller scans the position signal 222 from the rack driver, compares it to a previously set calibration value, and if they are not equal, sends a signal to the rack driver motors 214, causing them to move the rack to the calibration position. Meanwhile, the rack mounted induction sensors 190 detect the calibration jigs and send the usual frequency signals to the respective sensor electronics units 219 thereof, which convert the signals in turn to elevational signals that the controller can understand. Though the sensors can measure elevation over a wider range, to maximize their accuracy, we maintain them at substantially a fixed distance from the surfaces of the respective molten metal columns therebelow, using the bellows motors and the rack, but with a range of tolerance provided at that distance, so that the rack is not continually in use to idealize the vertical distance between the signal generation points of the respective sensors and the surfaces therebelow. See U.S. Pat. No. 5,339,885 in this connection. For example, the controller may be programmed to maintain the signal generation points of the respective sensors at an optimal distance of, say, 1 inch from the surfaces of the molten metal columns therebelow, but with a tolerance of 0.1 inch to either side of that distance. This range of tolerance is commonly referred to as the "dead band" or "dead band area" for the elevation of the respective sensors. At this stage in the calibration then, the controller internally "zeros" out the "dead band" , say, at 1 inch, and retains this calibrated reading before the jigs are removed. Meanwhile, the controller 188 also sends a signal to the respective air pressure controllers 232 which each convert it to a pressure signal for the respective bellows motor thereof that is designed to move the balance beam corresponding thereto to a specified calibration position. Thereafter, each valve closure device is moved up or down until it "seats" lightly at the bottom of its respective nozzle.

Once calibration has been accomplished, the controller sends a new signal to the respective air pressure controllers which in turn send a new air pressure signal to each bellows motor causing it to position its respective valve closure device at a preset "free fill" position for the start of the casting procedure. The controller also reads the position signal from the rack driver, compares it with a preset initialization value, then sends a signal to the rack driver motors telling them to move the rack to a start position for the cast. The respective preset "free fill" positions for the valve closure devices are determined in a trial and error sequence during the initial set up of the assembly, and therefore, when molten metal is introduced to the trough at the entry end thereof, it flows through the downspouts around the valve closure devices therein and into the cavities below in a manner designed to substantially stabilize the surfaces of the respective molten metal columns in the sumps at an intermediate elevation between the tops of the blocks and the start-up elevation for the casting operation. Then, as the surfaces continue to rise in a horizontal and reach the "zero" point in the dead band for the sensors, as indicated by the converted signals from the respective sensors, the controller begins to sum the position signal of the rack with the value of the converted sensor signals, and compares this summed value in turn with a predetermined time/position ramp or rate desired for the escalation of the surfaces during the remainder of the fill operation. See FIG. 21. If this summed value does not equal the value for that particular moment on the ramp, the controller will increase or decrease its signal 230 to the air pressure controllers by way of adjusting the air pressure therein to cause the respective bellows motors thereof to adjust their respective valve devices in turn, either to increase or decrease the flow of metal to the respective cavities, thus imposing a desired value on the rate at which the respective surfaces continue to escalate up the axes of the cavities at this stage in the casting procedure.

When the surfaces of the respective molten metal columns rise to a point, however, at which they move out of the range of tolerance or "dead band area" allotted to the distance between the surfaces and the respective signal transmission points of the sensors, as indicated to the controller by the signals from the respective sensor electronics units, the controller will send a signal 224 to the rack driver motors causing them to move the rack and thus the sensors thereon, back within the dead band thereof, for example, back within a range of 1 inch plus or minus 0.1 inch. Typically, the controller will scan the converted signals from the respective sensors, and use either the highest, the lowest or the average value therefrom, in determining whether to power the rack driver motors or not. See FIG. 22.

Alternatively, as the surfaces of the respective molten metal columns continue to rise in a horizontal and reach the "zero" point of the dead band, as indicated by the converted sensor signals from the respective sensor electronics units, the controller may be programmed instead to send a signal 224 to the rack driver motors causing them to power the rack driver and thus the rack and the mounted sensors thereon, in the upward direction. Thereafter, through monitoring the position signal 222 from the rack driver, the controller can raise the rack along any time/position ramp desired for the rate at which the surfaces escalate up the axes of the cavities. In the meantime, when the sensors rise with the rack, and the surfaces of the respective molten metal columns fall out of the "zero" point of the dead band, as indicated by the converted signals from the respective sensor electronics units, the controller will send a signal 230 to the respective air pressure controllers which is designed to generate that air pressure signal in the respective bellows motors thereof which is needed to make the input signals to the respective valve closure devices thereof consistent with the desired ramp for the rate at which the surfaces escalate up the axes of the cavities. See FIG. 23.

When the surfaces of the respective molten metal columns have reached the start-up elevation which was programmed into the controller, and which is indicated by the position signal from the rack driver, summed with the converted signals from the sensor electronics, the controller may thereafter maintain the operating elevation for the casting operation by monitoring the summed signals, and if the summed value does not equal the value necessary to maintain the operating elevation, the controller will send a signal 230 to the air pressure controllers designed to restore the surfaces to the desired operating elevation. Meanwhile, if the surfaces fall out of the "dead band area" for the sensors, and as indicated by the converted signals from the respective sensor electronics units, the controller will send a signal to the rack driver motors causing them to relocate the rack and the sensors back within the dead band area. Once again, in doing so, the controller will commonly scan the converted signals to use either the highest, the lowest or an average value in determining whether to send a power signal to the rack driver motors or not.

Alternatively, the controller may employ only the bellows motors to maintain the surfaces at a desired operating elevation for the casting operation.

As indicated earlier, the balance beams 196 for the respective valve devices 192 are biased to close the respective valve openings in the trough, and the bellows motors 208 are positioned under them to raise the respective beams against the bias to open the valves, or to relax and allow the valves to close in turn. However, when molten metal flows through the bottoms of downspouts, it sometimes creates a suction on the pins of the respective valve devices, tending to draw them into the valve openings of the downspouts with it and thereby create a back pressure on the actuators of the bellows motors. The dampener device incorporated into each motor in FIG. 24 acts to counteract this effect, that is, to resist relatively low pressure feedback signals which would otherwise be fed into the pneumatic input signals from the air pressure controllers.

Figure 24:
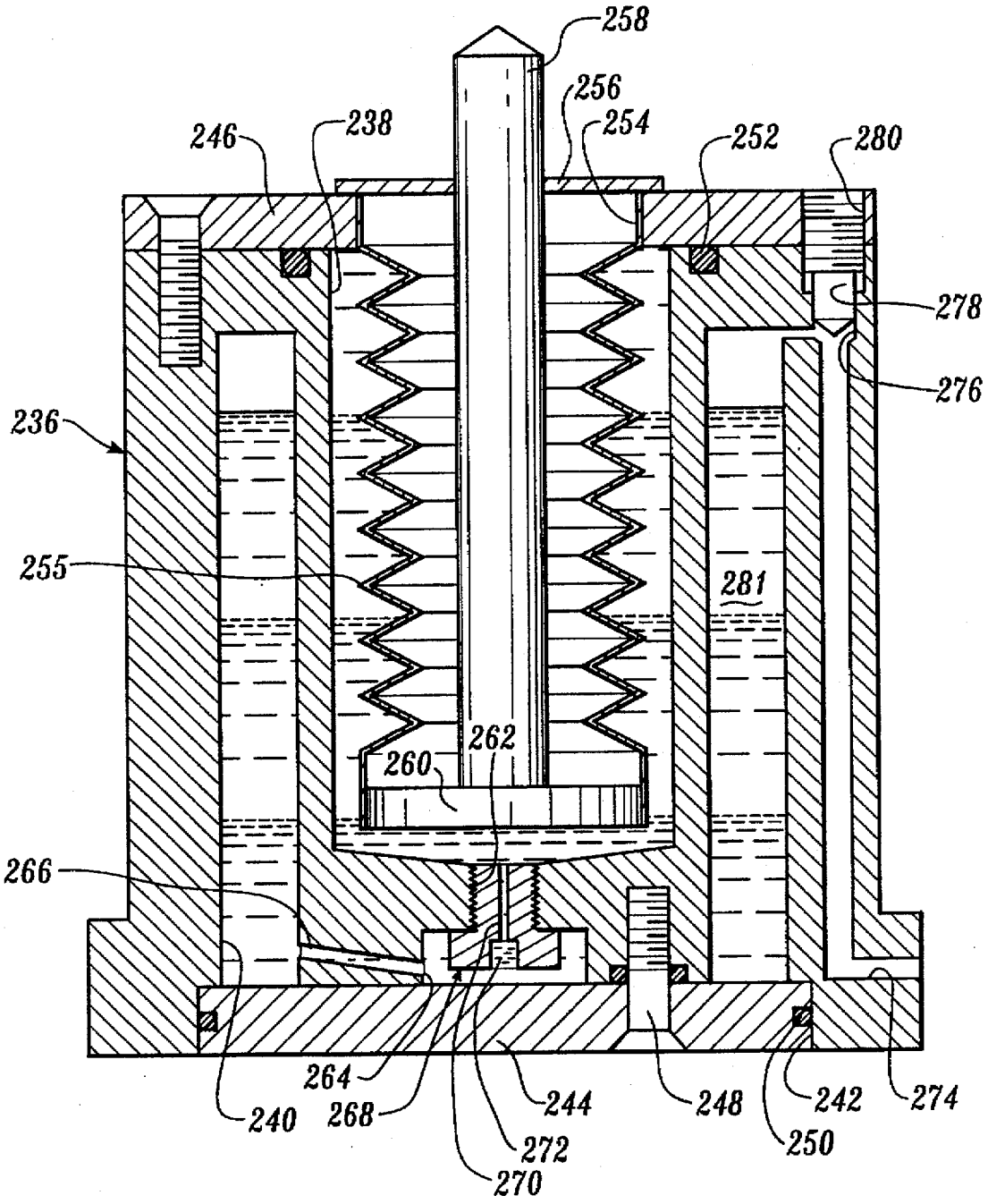
FIG. 24 is a cross sectional view of one of the bellows motors used in the assembly, and showing in particular a dampening device incorporated therein.

As seen in FIG. 24, each motor 208 comprises a cylindrical block 236 with a bore 238 in the top thereof at its vertical axis. The bottom of the block also has a cylindrical bore 240 therein, which is annular and circumposed about the axial bore 236 in the top thereof. The bore at the bottom is also counterbored at 242, and a cover 244 is applied to the bore 240, in the counterbore 242 thereof, and another cover 246 is applied to the top of the block, using machine screws 248. Elastomeric sealing rings are also used at 250 and 252, about and below the respective covers.

The top cover 246 is annular, and the opening 254 at the center thereof has the bladder 255 of the bellows motor suspended about the perimeter thereof, with a cover plate 256 thereover which is also annular to accommodate the linear actuator 258 of the bellows motor. The actuator in turn has a disk 260 at the bottom thereof, about the perimeter of which the bladder is secured to close it at its interior. Below the disk, the bottom of the bore 238 is slightly swaled, and at the axis of the device, the bore 238 opens into the bottom of the block through a threaded hole 262 therein, which is counterbored about the bottom end thereof, to form a small chamber 264 about the axis between the bottom cover 244 and the hole 262 on the axis of the block. A still smaller hole 266 angles into the chamber from the bore 240, and a slotted screw 268 is threaded into the hole 262 at a head diameter less than that of the chamber. The screw in turn has a narrow diameter hole 270 therethrough at the axis of the device, which communicates at its upper end with the bore 238, and at its lower end with the slot 272 in the screw and the chamber itself.

The block is flanged at the bottom thereof, and an L-shaped passage 274 is formed at the periphery of the block on one side thereof. The passage opens at the flange and communicates at its top with the top of the annular bore 240 of the block. A valve seat 276 is formed at the top of the passage so that a set screw 278 can be threadedly inserted in the passage from a socket 280 in that portion of the block above the passage. The screw is engaged in the valve seat when the dampener device is out of use, for example, when the assembly is undergoing shipment, tilted up or otherwise not disposed in a vertical condition.

When assembled, oil 281 is charged into the reservoir provided by the block at the respective chambers 238 and 240 thereof, and the oil in turn also occupies the chamber 264 below the bore 238, the hole 266 between the chamber and the bore 240, and the restricted hole 270 in the screw between the bore 238 and the chamber. When the device is put to use, the lead 235 for the pneumatic pressure signal from the respective air pressure controller for the device, is attached to the open end of the passage 274 in the flange of the block. The resulting connection operates to feed the pneumatic signal to the top of the oil charge in the bore 240, and the signal is transferred in turn through the charge to the bladder 255 of the motor. The oil-borne signal then collapses the bladder, or allows it to expand, depending on the character of the signal, and this effect is transferred to the disk 260 in turn, which in turn transfers the signal to the actuator 258, and the actuator in turn to the balance beam 196 of the respective casting station. On the other hand, when the beam transfers a feedback signal to the actuator, and the actuator in turn to the driven end 260 of the motor, that signal is resisted by the restriction the charge 281 encounters at the hole 270 of the screw. As a result, each feedback signal seldom has any effect on the setting of the valve device in the nozzle 206 of the corresponding downspout 194.

Figure 25:
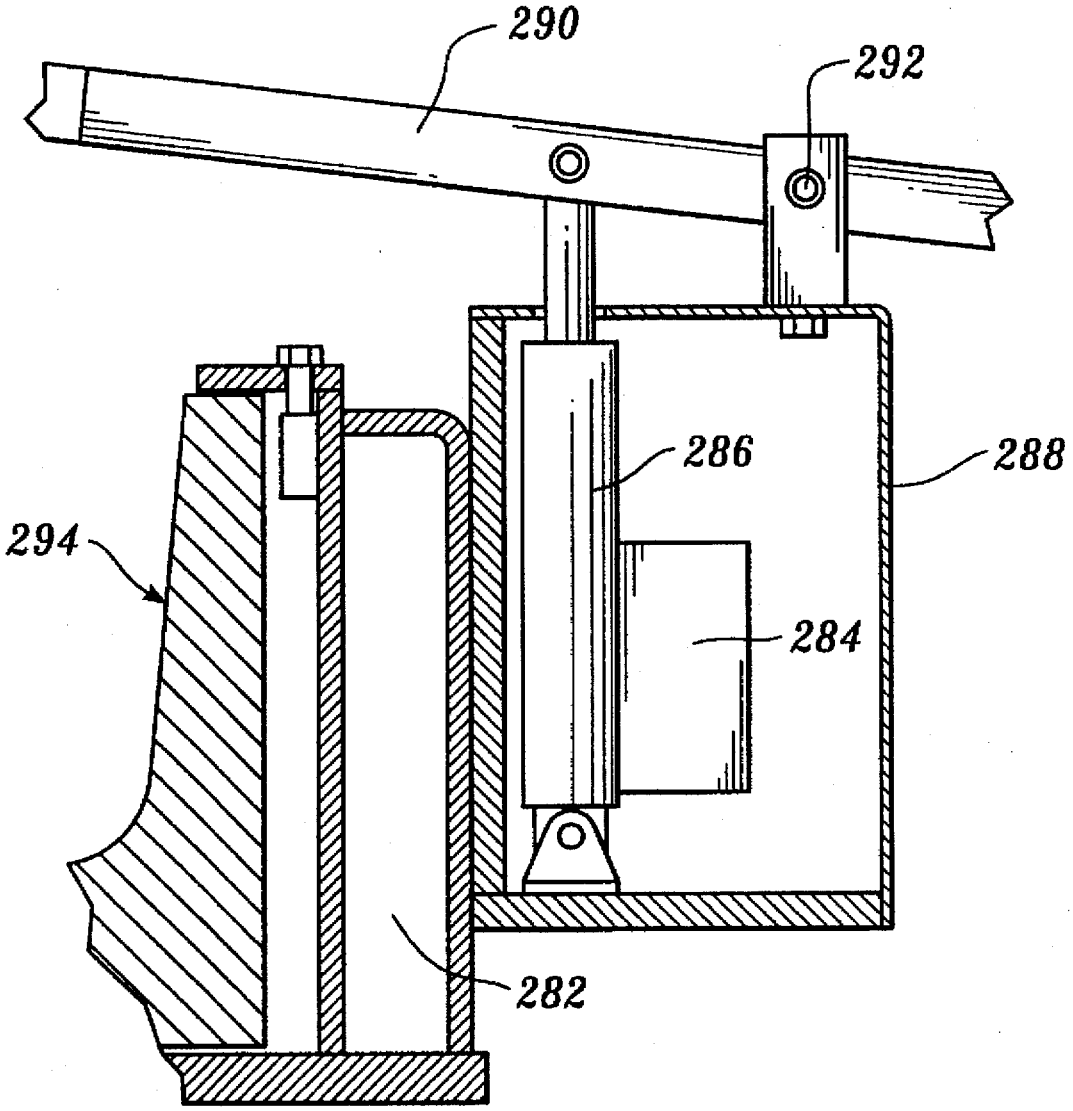
FIG. 25 is a part elevational view of the less desirable electromechanical alternative to the electro pneumatic version.

In FIG. 25, we have illustrated the fact that each signal from the electronic controller 188 can be sent by way of a trough mounted wireway 282 to the reversible electric motor 284 of a linear actuator 286 which is housed in a case 288 at the respective casting station on the wireway, and pivotally interconnected with the balance beam 290 for the respective valve closure device at an outboard point thereon spaced apart from the fulcrum 292 of the respective beam at the top of the case. However, this is a less desirable way to deliver the input signals to the respective valve closure devices, because once again, electrical leads and electrical components are stationed directly at the trough 294 and above the heat of the cavities.

We claim:

1. In the process of casting molten metal into elongated bodies of metal by the steps of introducing the molten metal into one end of an elongated trough which is arranged above a molten metal casting apparatus and has means in the bottom thereof defining a series of valve openings which are spaced apart from one another in a line extending along a parallel to the bottom of the trough and are in registry with relatively upper end openings of a series of open ended mold cavities in the casting apparatus which are spaced apart on vertical axes and disposed so that relatively lower end openings of the respective cavities coincide with a plane parallel to the line of valve openings, and which also have a series of bottom blocks telescopically engaged therein at the relatively lower end openings thereof to form sumps within the cavities for the temporary retention of molten metal therein so that the molten metal admitted to the respective cavities at the valve openings corresponding thereto forms columns of molten metal upright on the tops of the blocks which escalate up the axes of the cavities at the upper surfaces thereof to partially fill the sumps, and then when the upper surfaces of the respective molten metal colunms have risen to an elevation above the tops of the blocks at which the colunms sufficiently fill the sumps to warrant start-up of the casting operation, withdrawing the blocks relatively downwardly away from the casting apparatus along the axes of the cavities to release the columns for travel along the axes while continuing to admit molten metal to the respective cavities at the series of valve openings to maintain the upper surfaces of the respective molten metal columns at an operating elevation in which, as the respective molten metal colunms cool, the columns also increase their length to form elongated bodies of metal supported upright on the blocks, controlling the admission of the molten metal to the cavities during the casting procedure by:

supporting on sets of first and second carrier means which are each arranged in a line extending parallel to the line of valve openings and each supported so that the respective carrier means therein are reciprocable relatively transverse the line thereof, sets of valve closure devices and sensor devices which are operable to control the admission of molten metal to the respective cavities at the respective valve openings corresponding thereto, and to sense the elevation of the upper surfaces of the respective molten metal columns formed in the respective cavities during the casting procedure and to transmit signals representing the elevations of the respective upper surfaces, respectively, the set of valve closure devices being suspended from the set of first carrier means so as to be disposed in cooperative engagement with the respective valve openings corresponding thereto, and to be reciprocated in conjunction with the respective first carrier means corresponding thereto between variable positions in relation to the respective valve openings at which the molten metal is admitted to the respective cavities at variable flow rates commensurate the respective positions, and the set of sensor devices being suspended from the set of second carrier means so as to be spaced above the tops of the blocks forming the respective sumps corresponding thereto, and to generate the respective signals thereof at points spaced above the upper surfaces of the respective molten metal columns formed in the sumps during the fill operation, at the commencement of the fill operation, prepositioning the set of valve closure devices at positions in which the respective valve closure devices admit the molten metal to the respective sumps corresponding thereto in amounts that are varied commensurate with the distance lying along the line of valve openings between each of the respective valve openings and a vertical through the one end of the trough, so that as the upper surfaces of the respective molten metal columns escalate up the axes of the cavities toward the sensor devices corresponding thereto during the initial phase of the fill operation, the upper surfaces of the respective molten metal columns establish a state of substantial equilibrium with one another at an intermediate elevation between the tops of the blocks and the start-up elevation for the casting operation, and when the upper surfaces of the respective molten metal columns have established a state of substantial equilibrium with one another at the intermediate elevation, interconnecting with each of the respective sensor devices and the respective first and second carrier means corresponding thereto, a control device which is operable to transmit to the respective valve closure devices corresponding thereto, input signals which are both a function of the vertical distance between the line of second carrier means and a reference plane parallel to the plane with which the relatively lower end openings of the cavities coincide, and a function of the vertical distance between the signal generation points of the respective sensor devices and the upper surfaces of the respective molten metal columns corresponding thereto, reciprocating one of the sets of first and second carrier means relatively transverse the line thereof to impose a desired value on the rate at which the upper surfaces of the respective molten metal columns escalate up the axes of the cavities in the direction of the start-up elevation from the intermediate elevation, and reciprocating the other of the sets of first and second carrier means relatively transverse the line thereof so that as the upper surfaces of the respective molten metal columns escalate up the axes of the cavities at the desired value, the elevation of the signal generation points of the respective sensor devices is raised at a rate sufficiently commensurate with the desired value to render the input signals transmitted to the respective value closure devices by the control device substantially consistent with the desired value.

2. The process according to claim 1 wherein when the upper surfaces of the respective molten metal columns reach the start-up elevation and the blocks are withdrawn relatively downwardly away from the casting apparatus along the axes of the cavities to start the casting operation, the one set of carrier means is reciprocated in an additional step to maintain the upper surfaces of the respective molten metal columns at the start-up elevation as an operating elevation for the casting operation.

3. The process according to claim 2 wherein the other set of carrier means is also reciprocated during the additional step to maintain the elevation of the signal generation points of the respective sensor devices within a predetermined range of vertical distance from the upper surfaces of the respective molten metal columns corresponding thereto.

4. The process according to claim 1 wherein when the upper surfaces of the respective molten metal columns reach the start-up elevation and the blocks are withdrawn relatively downwardly away from the casting apparatus along the axes of the cavities to start the casting operation, the one set of carrier means is reciprocated in an additional step, first, to raise the upper surfaces of the respective molten metal columns to an elevation spaced above the operating elevation, and then to lower the upper surfaces of the respective molten metal columns to the operating elevation for the casting operation.

5. The process according to claim 4 wherein the other set of carrier means is also reciprocated during the additional step to maintain the elevation of the signal generation points of the respective sensor devices within a predetermined range of vertical distance from the upper surfaces of the respective molten metal columns corresponding thereto.

6. The process according to claim 1 wherein when the upper surfaces of the respective molten metal columns reach the start-up elevation and the blocks are withdrawn relatively downwardly away from the casting apparatus along the axes of the cavities to start the casting operation, the one set of carrier means is reciprocated in an additional step, first, to raise the upper surfaces of the respective molten metal columns to a still higher elevation spaced above the start-up elevation, and then to maintain the upper surfaces of the respective molten metal columns at the still higher elevation as an operating elevation for the casting operation.

7. The process according to claim 6 wherein the other set of carrier means is also reciprocated during the additional step to maintain the elevation of the signal generation points of the respective sensor devices within a predetermined range of vertical distance from the upper surfaces of the respective molten metal columns corresponding thereto.

8. The process according to claim 1 wherein when the upper surfaces of the respective molten metal columns have reached the start-up elevation, an operating elevation has been established of at least the start-up elevation, the blocks have been withdrawn relatively downwardly away from the casting apparatus along the axes of the cavities at a particular speed during a first portion of the casting operation, and then are withdrawn relatively downwardly away from the casting apparatus along the axes at a second and different speed during a second portion of the casting operation, and the one set of carrier means is reciprocated in an additional step to relocate the upper surfaces of the respective molten metal columns to a new operating elevation commensurate with the second speed.

9. The process according to claim 8 wherein the other set of carrier means is also reciprocated during the additional step to maintain the elevation of the signal generation points of the respective sensor devices within a predetermined range of vertical distance from the upper surfaces of the respective molten metal columns corresponding thereto.

10. The process according to claim 1 wherein the sensor devices take the form of non-contact sensors, the sensors are suspended from the set of second carrier means so as to have signal generation points at a predetermined vertical distance above the upper surfaces of the respective molten metal columns corresponding thereto when the upper surfaces establish a state of substantial equilibrium with one another at the intermediate elevation, and the other set of carrier means is reciprocated to raise the elevation of the signal generation points of the respective sensors at a rate whereby the respective signal generation points maintain a predetermined range of vertical distance above the upper surfaces of the respective molten metal columns corresponding thereto that includes the aforesaid predetermined vertical distance.

11. The process according to claim 10 wherein the set of first carrier means is reciprocated to impose the desired value on the rate at which the upper surfaces of the respective molten metal columns continue to escalate up the axes of the cavities after the initial phase of the fill operation, and the set of second carrier means is reciprocated to raise the signal generation points of the respective sensors at a rate whereby the respective signal generation points maintain the predetermined range of vertical distance above the upper surfaces of the respective molten metal columns corresponding thereto.

12. The process according to claim 10 wherein the set of second carrier means is reciprocated to impose the desired value on the rate at which the upper surfaces of the respective molten metal coitus continue to escalate up the axes of the cavities after the initial phase of the fill operation, and the set of first carrier means is reciprocated to raise the signal generation points of the respective sensors at a rate whereby the respective signal generation points maintain the predetermined range of vertical distance above the upper surfaces of the respective molten metal columns corresponding thereto.

13. The process according to claim 1 wherein the sensor devices take the form of contact sensors, the sensors are suspended from the set of second carrier means so as to contact the upper surfaces of the respective molten metal columns corresponding thereto and to have signal generation points spaced thereabove at substantially a fixed vertical distance from the upper surfaces of the respective molten metal columns corresponding thereto when the upper surfaces establish a state of substantial equilibrium with one another at the intermediate elevation, and the other set of carrier means is reciprocated to raise the signal generation points of the respective sensors at a rate whereby the respective signal generation points maintain substantially the fixed vertical distance above the upper surfaces of the respective molten metal columns without lift from the columns themselves at the upper surfaces thereof.

14. The process according to claim 13 wherein the set of first carrier means is reciprocated to impose the desired value on the rate at which the upper surfaces of the respective molten metal columns continue to escalate up the axes of the cavities after the initial phase of the fill operation, and the set of second carrier means is reciprocated to raise the signal generation points of the respective sensors at a rate whereby the respective signal generation points maintain substantially the fixed vertical distance above the upper surfaces of the respective molten metal columns without lift from the columns themselves at the upper surfaces thereof.

15. The process according to claim 14 wherein the of first carrier means is mounted on the set of second carrier means, and the set of second carrier means is reciprocated to impose the desired value and raise the signal generation points the same time.

16. The process according to claim 1 wherein the sensor devices take the form of sensors which transmit first signals at the respective signal generation points thereof when contacted by the upper surfaces of the respective molten metal columns in the sumps, and wherein the control device takes the form of rotary actuators which are pivotally mounted at fulcra on the respective second carrier means, yieldably biased to rotate about the respective fulcra thereof in the direction of the tops of the blocks corresponding thereto, and have the respective sensors suspended therefrom at the respective signal generation points thereof to integrate with the respective first signals when the respective sensors are contacted by the upper surfaces of the respective molten metal columns corresponding thereto after the initial phase of the fill operation, second signals representing the vertical distance between the line of second carrier means and the reference plane and to deliver the respective integrated first and second signals as input signals to drive means which are interposed between the respective rotary actuators and the respective first carrier means corresponding thereto, to vary the positions of the respective valve closure devices suspended therefrom relative to the respective valve openings corresponding thereto.

17. The process according to claim 16 wherein the set of valve closure devices is prepositioned at the commencement of the fill operation, by releasably detaining the respective rotary actuators against the bias thereon at angular positions disposed about the fulcra on the respective second carrier means corresponding thereto in which the respective valve closure devices admit the molten metal to the respective sumps corresponding thereto in the amounts described until the respective sensors are contacted by the upper surfaces of the respective molten metal columns corresponding thereto at the intermediate elevation.

18. The process according to claim 17 wherein the respective first carrier means are rigidly interconnected with the respective rotary actuators corresponding thereto by drive connections therebetween to form balance beams having the beams having the respective valve closure devices and sensor suspended from points thereon which are spaced apart from the respective fulcra thereof on the respective second carrier means corresponding thereto, and trigger devices are engaged with the respective balance beams to releasably detain the respective rotary actuators thereof against the bias thereon until the upper surfaces of the respective molten metal columns engage the sensors to disengage the trigger devices from the respective rotary actuators.

19. The process according to claim 1 wherein the sensor devices take the form of sensors which transmit first electrical signals at the signal generation points thereof when spaced apart from the upper surfaces of the respective molten metal columns formed in the respective sumps corresponding thereto, and the control device takes the form of an electronic controller which is connected to the respective sensors and the respective second carrier means corresponding thereto, to integrate with the respective first electrical signals when the upper surfaces of the respective molten metal columns assume a state of substantial equilibrium with one another at the intermediate elevation, second electrical signals representing the vertical distance between the line of second carrier means and the reference plane, and to deliver the integrated first and second electrical signals as input signals to drive means which are interposed between the controller and the respective first carrier means corresponding to the respective sensors, to vary the positions of the respective valve closure devices suspended from the respective first carrier means relative to the respective valve openings corresponding thereto.

20. The process according to claim 19 wherein the drive means take the form of electric motor driven actuator devices.

21. The process according to claim 19 wherein the drive means take the form of pneumatically driven actuator devices, and further comprising interposing a signal conversion device between the electronic controller and the respective actuator devices to convert electrical input signals transmitted by the electronic controller into pneumatic input signals for the respective pneumatically driven actuator devices.

22. The process according to claim 21 further comprising interposing fluid dampener devices between the respective actuator devices and the signal conversion device to resist the introduction of relatively low pressure feedback signals to the respective pneumatic input signals for the actuator devices when suction occurs in the respective valve openings corresponding to the respective actuator devices.

23. The process according to claim 21 wherein the actuators take the form of bellows motors having driven ends thereon, liquid reservoirs are interposed between the signal conversion device and the respective bellows motors, restricted liquid flow passages are formed within the respective reservoirs that communicate at corresponding ends thereof with the pneumatic input signals from the signal conversion device and at opposing ends thereof with the driven ends of the respective bellows motors, and the respective passages are charged with dampener liquid that is contained by the respective reservoirs corresponding thereto, to transmit the respective pneumatic pressure signals to the driven ends of the respective bellows motors corresponding thereto, but substantially resist the transmission of relatively low pressure feedback signals to the respective pneumatic input signals from the driven ends of the respective bellows motors because of the restriction in the respective liquid flow passages.

24. The process according to claim 1 wherein the set of second carrier means is mounted on elevator means to be reciprocated therewith along parallels to the axes of the cavities.

25. The process according to claim 24 further comprising interconnecting the respective second carrier means with one another along the line thereof to form a rack for the respective sensor devices.

26. The process according to claim 25 further comprising elongating the rack along the line thereof so that the rack is coextensive with the line of valve openings, and suspending the respective sensor devices below the rack at points thereon opposed to the respective valve openings corresponding thereto.

27. The process according to claim 26 wherein the control device takes the form of an electronic controller.

28. The process according to claim 25 further comprising elongating the rack along the line thereof so that the rack is coextensive with the line of valve openings, and supporting the respective sensor devices on top of the rack at points thereon opposed to the respective valve openings corresponding thereto.

29. The process according to claim 28 wherein the control device takes the form of rotary actuators which are pivotally mounted at fulcra on the rack, the respective first carrier means corresponding thereto are rigidly interconnected with the respective actuators to form balance beams, and the respective valve closure devices and sensor devices corresponding to the respective first carrier means are pivotally suspended from the relatively outboard end portions of the respective balance beams at points spaced apart from the respective fulcra thereof.

30. The process according to claim 1 wherein the bottom of the trough has downspouts suspended therefrom, which define the valve openings, and further comprising suspending the valve closure devices in the downspouts to cooperatively engage with the respective valve openings thereof.

* * * * *

UNITED STATES PATENT AND TRADEMARK OFFICE

CERTIFICATE OF CORRECTION

PATENT NO. : 5,709,260
DATED : January 20, 1998
INVENTOR(S) : Frank Everton Wagstaff; Aaron David Sinden; David Alan Salee It is certified that error appears in the above–identified patent and that said Letters Patent is hereby corrected as shown below:

Column 23, line 64, after "commensurate" add --with--;

Column 26, line 15, change "coitus" to --columns--;

Column 27, line 24, omit "beams having the";

Column 27, line 25, add "s" to sensor;

Signed and Sealed this

Twenty-first Day of April, 1998

Bruce Lehman

*Attest:*

BRUCE LEHMAN

*Attesting Officer*

*Commissioner of Patents and Trademarks*